US008536086B2

(12) United States Patent
Kawahara et al.

(10) Patent No.: US 8,536,086 B2
(45) Date of Patent: Sep. 17, 2013

(54) THERMOSENSITIVE RECORDING MEDIUM AND IMAGE PROCESSING METHOD USING THE SAME

(75) Inventors: Shinya Kawahara, Numazu (JP); Tomomi Ishimi, Numazu (JP); Toshiaki Asai, Numazu (JP); Yoshihiko Hotta, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 450 days.

(21) Appl. No.: 12/695,846

(22) Filed: Jan. 28, 2010

(65) Prior Publication Data

US 2010/0197492 A1 Aug. 5, 2010

(30) Foreign Application Priority Data

Jan. 30, 2009 (JP) ..... 2009-020922

(51) Int. Cl.
*B41M 5/42* (2006.01)
*B41M 5/46* (2006.01)

(52) U.S. Cl.
USPC ..... 503/201; 503/226

(58) Field of Classification Search
None
See application file for complete search history.

(56) References Cited

U.S. PATENT DOCUMENTS

| | | | | |
|---|---|---|---|---|
| 5,804,529 | A * | 9/1998 | Komatsu | 503/226 |
| 7,439,993 | B2 | 10/2008 | Ishimi et al. | |
| 2003/0118851 | A1 | 6/2003 | Minami | |
| 2007/0036039 | A1 | 2/2007 | Kawahara et al. | |
| 2007/0225162 | A1 | 9/2007 | Kawahara et al. | |
| 2008/0151033 | A1 | 6/2008 | Ishimi et al. | |
| 2008/0153698 | A1 | 6/2008 | Kawahara et al. | |
| 2008/0214391 | A1 | 9/2008 | Kawahara et al. | |
| 2008/0242539 | A1 | 10/2008 | Yamamoto et al. | |
| 2009/0029854 | A1 | 1/2009 | Maruyama et al. | |
| 2009/0075816 | A1 | 3/2009 | Kawahara et al. | |
| 2009/0203521 | A1 | 8/2009 | Ishimi et al. | |

FOREIGN PATENT DOCUMENTS

| | | |
|---|---|---|
| CN | 101137512 A | 3/2008 |
| JP | 5-8537 | 1/1993 |
| JP | 7-205547 | 8/1995 |
| JP | 9-175024 | 7/1997 |
| JP | 11-151856 | 6/1999 |
| JP | 2000-136022 | 5/2000 |
| JP | 2004-160806 | 6/2004 |
| JP | 2004-265247 | 9/2004 |
| JP | 2005-107388 | 4/2005 |
| JP | 3998193 | 8/2007 |

OTHER PUBLICATIONS

Jan. 25, 2011 Chinese official action in connection with a counterpart Chinese patent application.
Jun. 18, 2010 European search report in connection with a counterpart European patent application No. 10152265.

* cited by examiner

*Primary Examiner* — Bruce H Hess
(74) *Attorney, Agent, or Firm* — Cooper & Dunham LLP

(57) ABSTRACT

A thermosensitive recording medium including a support; a layer containing a photothermal conversion material, formed over a surface of the support; and an oxygen blocking layer formed over a surface of the layer opposite to a surface thereof over which the support is formed, wherein the layer further contains a resin, which is in a cross-linked state, and the photothermal conversion material absorbs a light having a specific wavelength and converts the light into heat, and wherein the oxygen blocking layer has an oxygen permeability of 0.5 mL/($m^2$·24 hr·atm) or less at 25° C. and 80% RH.

16 Claims, 14 Drawing Sheets

THERMOSENSITIVE RECORDING MEDIUM AND IMAGE PROCESSING METHOD USING THE SAME

BACKGROUND OF THE INVENTION

1. Field of the Invention

The present invention relates to a thermosensitive recording medium having an excellent light resistance, and an image processing method using the thermosensitive recording medium.

2. Description of the Related Art

Each image has been so far recorded and erased on a thermosensitive recording medium, (hereinafter, also referred to as "thermoreversible recording medium" or "recording medium") by a contact method in which the recording medium is heated by making contact with a heat source. For the heat source, in the case of image recording, a thermal head is generally used, and in the case of image erasing, a heat roller, a ceramic heater or the like is generally used.

Such a contact image processing method has advantages in that when a thermoreversible recording medium is composed of a flexible material such as film and paper, an image can be uniformly recorded and erased by evenly pressing a heat source against the thermoreversible recording medium with use of a platen, and an image recording device and an image erasing device can be produced at cheap cost by using components of a conventional thermosensitive printer.

However, when a thermoreversible recording medium incorporates an RF-ID tag as described in Japanese Patent Application Laid-Open (JP-A) No. 2004-265247 and Japanese Patent (JP-B) No. 3998193, the thickness of the thermoreversible recording medium is thickened and the flexibility thereof is degraded. Therefore, to uniformly press a heat source against the thermoreversible recording medium, it needs a high-pressure. When irregularity is formed on a surface of the thermoreversible recording medium, it is difficult to record and erase an image using a thermal head or the like. In view of the fact that RF-ID tag enables reading and rewriting of memory information from some distance away therefrom in a non-contact manner, a demand arises for thermoreversible recording media as well. The demand is that an image be rewritten on such a thermoreversible recording medium from some distance away therefrom.

Consequently, a recording method using a laser in a non-contact manner is proposed as a method of recording and erasing each image on a thermoreversible recording medium from some distance away from the thermoreversible recording medium, or on a surface having irregularities of the thermoreversible recording medium (see JP-A No. 2000-136022).

An image recording and erasing method using a laser has been proposed, wherein a recording medium including a leuco dye, a reversible developer and various photothermal conversion materials in combination is used, and recording is performed thereon using a near infrared laser light (see JP-A Nos. 05-8537 and 11-151856).

However, the leuco dye has a problem that it is decomposed by light and oxygen, when exposed to sunlight the outdoors for a long period of time, and a background of a thermoreversible recording medium turns brownish. Moreover, there is another problem that when an image is recorded on the thermoreversible recording medium, and then is exposed to sunlight for a long period of time in the presence of oxygen, an image density thereof is decreased or the image cannot be completely erased however hard it is tried. Moreover, when the organic coloring matter having an absorption in the near infrared region, which is described in JP-A Nos. 05-8537 and 11-151856 is used as the photothermal conversion material, the organic coloring matter generally has low light resistance, and the decomposition of the organic coloring matter decreases the absorption in the near infrared region. Thus, the recording sensitivity and erasure sensitivity are significantly decreased.

To solve these problems, it has been attempted that an ultraviolet absorbing layer and an oxygen blocking layer are provided in a thermoreversible recording medium (JP-A Nos. 07-205547 and 09-175024).

Moreover, it has been proposed that a thermoreversible recording layer is sandwiched by a PET film having an oxygen permeability of 6 mL/($m^2$·24 hr·atm) at 20° C. and 60% RH and a resin film of an ethylene-vinyl alcohol copolymer having an oxygen permeability of 0.2 mL/($m^2$·24 hr·atm) at 20° C. and 60% RH (see JP-A No. 2004-160806). However, the resin film of an ethylene-vinyl alcohol copolymer is easily influenced by humidity, and the film absorbs moisture in a high humidity environment, such as the outdoors in summer, thereby increasing the oxygen permeability thereof, and oxygen cannot be sufficiently blocked. Thus, the resin film has insufficient light resistance and complete erasure cannot be performed.

Moreover, as disclosed in JP-A No. 2004-160806, in the case where, on the thermoreversible recording medium in which the photothermal conversion material is contained in a resin having a low heat resistance, such as an adhesive layer, image recording and erasing are repeatedly performed using a laser, the layer containing the photothermal conversion material is repeatedly heated at high temperature, and the resin component around the photothermal conversion material and the photothermal conversion material itself may be decomposed into gas. The generated gas is not let off from the thermoreversible recording medium and air bubbles are formed on the surface thereof, causing undesirable appearance, because the oxygen blocking layer is provided in the thermoreversible recording medium. This is a severe problem for practical use. This problem is not described in JP-A No. 2004-160806, and the inventors of the present invention has found for the first time. In view of this point, the improvement of the light resistance and durability against repeated use of the thermoreversible recording medium has been demanded at present.

BRIEF SUMMARY OF THE INVENTION

An object of the present invention is to provide a thermosensitive recording medium having excellent light resistance, in which decrease in image density caused by light irradiation less occurs, particularly, the thermosensitive recording medium having sufficient decoloring property even though it is exposed to light for a long time, and having excellent light resistance and durability against repeated use, in which a surface of the thermosensitive recording medium is not damaged in appearance even though image recording and erasing are repeatedly performed, and an image processing method using the thermosensitive recording medium.

Means for solving the problems are as follows

<1> A thermosensitive recording medium including a support; a layer containing a photothermal conversion material, formed over a surface of the support; and an oxygen blocking layer formed over a surface of the layer opposite to a surface thereof over which the support is formed, wherein the layer further contains a resin, which is in a cross-linked state, and the photothermal conversion material absorbs a light having a specific wavelength and converts the light into heat, and wherein the oxygen blocking layer has an oxygen permeability of 0.5 mL/($m^2$·24 hr·atm) or less at 25° C. and 80% RH.

<2> The thermosensitive recording medium according to <1>, wherein the thermosensitive recording medium is a thermoreversible recording medium.

<3> The thermosensitive recording medium according to <2>, wherein the layer containing the photothermal conversion material is a thermoreversible recording layer, and the thermoreversible recording layer contains a leuco dye and a reversible developer, in which color tone reversibly changes by heat.

<4> The thermosensitive recording medium according to <2>, further including a thermoreversible recording layer containing a leuco dye and a reversible developer, in which color tone reversibly changes by heat, wherein the layer containing the photothermal conversion material is a photothermal conversion layer.

<5> The thermosensitive recording medium according to <4>, further containing another thermoreversible recording layer, wherein the layer containing the photothermal conversion material is a photothermal conversion layer, and the thermoreversible recording layers are formed over both surfaces of the photothermal conversion layer.

<6> The thermosensitive recording medium according to <4>, further containing an intermediate layer, wherein the layer containing the photothermal conversion material is a photothermal conversion layer, and the intermediate layer is formed between the photothermal conversion layer and the thermoreversible recording layer.

<7> The thermosensitive recording medium according to any one of <3> to <6>, further including another oxygen blocking layer which is formed any one of between the support and the thermoreversible recording layer, and on a surface of the support opposite to a surface thereof on which the thermoreversible recording layer is formed.

<8> The thermosensitive recording medium according to any one of <1> to <7>, wherein the oxygen blocking layer has an oxygen permeability of 0.1 mL/($m^2$·24 hr·atm) or less at 25° C. and 80% RH.

<9> The thermosensitive recording medium according to any one of <1> to <8>, wherein the oxygen blocking layer has an oxygen permeability of 0.05 mL/($m^2$·24 hr·atm) or less at 25° C. and 80% RH.

<10> The thermosensitive recording medium according to any on of <1> to <9>, wherein the oxygen blocking layer is an inorganic deposited film.

<11> The thermosensitive recording medium according to <10>, wherein the inorganic deposited film is a silica deposited polyethylene terephthalate film.

<12> The thermosensitive recording medium according to any one of <10> to <11>, wherein the inorganic deposited film is a laminate consisting of two or more layers.

<13> The thermosensitive recording medium according to any one of <3> to <12>, further containing an ultraviolet absorbing layer, wherein the ultraviolet absorbing layer is formed over a surface of the thermoreversible recording layer opposite to a surface thereof over which the support is formed.

<14> The thermosensitive recording medium according to <13>, wherein the ultraviolet absorbing layer contains a polymer having an ultraviolet absorption structure.

<15> An image processing method including any one of heating the thermosensitive recording medium according to any one of <1> to <14> with a laser light irradiation so as to record an image thereon; and heating the thermosensitive recording medium with a laser light irradiation so as to erase an image therefrom.

<16> The image processing method according to claim <15>, wherein the thermosensitive recording medium is a thermoreversible recording medium.

<17> The image processing method according to any one of <15> to <16>, wherein the laser light has a wavelength of 600 nm to 1,200 nm.

<18> The image processing method according to any one of <15> to <17>, wherein the laser light is at least one selected from the group consisting of a YAG laser light, a fiber laser light, and a semiconductor laser light.

The present invention can solve the conventional problems, and provide a thermosensitive recording medium having excellent light resistance, in which decrease in image density caused by light irradiation less occurs, particularly, the thermosensitive recording medium having sufficient decoloring property even though it is exposed to light for a long time, and having excellent light resistance and durability against repeated use, in which a surface of the thermosensitive recording medium is not damaged in appearance even though image recording and erasing are repeatedly performed, and an image processing method using the thermosensitive recording medium.

Figure 1A:
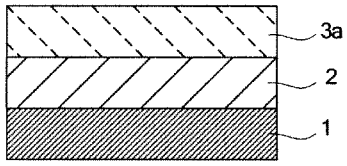
FIG. 1A shows an example of a layer configuration of a thermosensitive recording medium (also referred to as "thermoreversible recording medium" or "recording medium"), wherein a thermoreversible recording layer containing a photothermal conversion material is formed on a support, and a first oxygen blocking layer formed on the thermoreversible recording layer.

DETAILED DESCRIPTION OF THE INVENTION (Thermosensitive Recording Medium)

A thermosensitive recording medium (also referred to as "thermoreversible recording medium" or "recording medium") of the present invention includes at least a support and a layer containing a photothermal conversion material which absorbs a light having a specific wavelength and converts the light into heat, formed over a surface of the support, and includes an oxygen blocking layer, an ultraviolet absorbing layer, an intermediate layer, a protective layer, and if necessary, further includes other layers such as an undercoat layer, a back layer, an adhesion layer, a tackiness layer, a coloring layer, an air layer and a light-reflecting layer. Each of these layers may have a single-layer structure or a laminated structure.

On the recording medium of the present invention, an aspect of performing image recording once, and an aspect of repeatedly performing image recording and erasing can be performed in the same manner.

The thermosensitive recording medium is preferably a thermoreversible recording medium, on which image recording and erasing can be repeatedly performed.

Here, a layer containing the photothermal conversion material is a thermoreversible recording layer when the thermoreversible recording layer contains the photothermal conversion material, a photothermal conversion layer when the photothermal conversion layer contains the photothermal conversion material, or the thermoreversible recording layer and the photothermal conversion layer when both of the thermoreversible recording layer and the photothermal conversion layer contain the photothermal conversion material.

In the present invention, an oxygen blocking layer having an oxygen permeability of 0.5 mL/($m^2$·24 hr·atm) or less is formed, and the resin contained in the layer containing the photothermal conversion material is in a cross-linked state.

The reason is not clearly known, but since the resin is in the cross-linked state, the thermal decomposition of the resin component around the photothermal conversion material and the photothermal conversion material itself can be suppressed and gas generation can be suppressed, even though image recording and erasing are repeatedly performed using a laser so as to repeatedly heat the layer containing the photothermal conversion material at high temperature. As a result, even though the oxygen blocking layer having an oxygen permeability of 0.5 mL/($m^2$·24 hr·atm) or less at 25° C. and 80% RH is formed in the recording medium, air bubbles are not formed on a surface of the recording medium.

<Oxygen Blocking Layer>

The oxygen blocking layer has an oxygen permeability at 25° C. and 80% RH is 0.5 mL/($m^2$·24 h·atm) or less, preferably 0.1 mL/($m^2$·24 hr·atm) or less, more preferably 0.05 mL/($m^2$·24 hr·atm) or less. When the oxygen permeability is more than 0.5 mL/($m^2$·24 hr·atm), the oxygen blocking layer cannot sufficiently block oxygen. Thus, the oxygen blocking layer has insufficient light resistance and complete erasure cannot be performed.

Meanwhile, since the oxygen permeability depends on environmental temperature and humidity, it is preferred that the oxygen permeability be low not only at 25° C. and 80% RH, but also under the conditions of high temperature and high humidity, such as 30° C. and 80% RH or 35° C. and 80% RH.

Here, the oxygen permeability is measured, for example, in accordance with JIS K7126B (equal pressure), or ATSM D3985. As a measurement device, for example, oxygen permeability measurement devices, such as OX-TRAN2/21, OX-TRAN2/61 (manufactured by MOCON), and Model8001 (manufactured by Systech Instruments) are used.

As a material having the oxygen blocking property, polyvinyl alcohol or an ethylene-polyvinyl alcohol copolymer is generally used. However, as these materials are hydrophilic, they show an excellent oxygen blocking property at low humidity, but absorb water when ambient humidity becomes high, significantly decreasing the oxygen blocking property. In the case where these materials are used outdoors at high humidity in summer, oxygen blocking property cannot be sufficiently obtained. For example, the ethylene-polyvinyl alcohol copolymer having an ethylene content of 32 mol % has an oxygen permeability of 0.3 mL/($m^2$·24 hr·atm) to 0.5 mL/($m^2$·24 hr·atm) at 20° C. and 60% RH, but has an oxygen permeability of 1.1 mL/($m^2$·24 hr·atm) to 1.5 mL/($m^2$·24 hr·atm) at 20° C. and 80% RH. Moreover, the oxygen blocking property is decreased at high temperature, as an absolute humidity becomes high along with the elevation of the ambient temperature even though relative humidity remains the same.

As the oxygen blocking layer having an oxygen permeability of 0.5 mL/($m^2$·24 hr·atm) or less at 25° C. and 80% RH used in the present invention, a deposited layer of an inorganic oxide, such as silica, alumina, or the like, or an inorganic deposited film which is formed by depositing an inorganic oxide on a polymer film such as PET, nylon or the like, and examples thereof include a silica deposited film, an alumina deposited film, and a silica-alumina deposited film. Of these, the silica deposited film is particularly preferable, because it has high oxygen blocking property, and is inexpensive and less influenced by temperature or humidity. As a base material for the inorganic deposited film, polyethylene terephthalate (PET) is preferable, in terms of deposition suitability, stability of oxygen blocking property, and heat resistance.

The oxygen blocking layer is formed over a surface of the thermoreversible recording layer opposite to a surface thereof over which the support is formed, and preferably further formed at least one of between the support and the thermoreversible recording layer, and on a surface of the support opposite to a surface thereof on which the thermoreversible recording layer is formed.

The oxygen blocking layer is formed not only over the surface of the thermoreversible recording layer opposite to a surface thereof over which the support is formed, but also any one of between the support and the thermoreversible recording layer and on a surface of the support opposite to a surface thereof on which the thermoreversible recording layer is formed. Thus, the oxygen blocking layers are formed so as to sandwich the thermoreversible recording layer, thereby more effectively blocking oxygen.

Moreover, other layers such as a photothermal conversion layer, an ultraviolet absorbing layer, an intermediate layer, a protective layer, an adhesive layer, a tackiness layer, or the like, which will be described hereinafter, may be formed over a surface of the thermoreversible recording layer opposite to a surface thereof over which the support is formed, and between the oxygen blocking layer and the thermoreversible recording layer. Thus, oxygen ingress to the thermoreversible recording layer can be much effectively prevented, so that photodecomposition of a leuco dye can be suppressed.

The oxygen blocking layer formed over the support may be the same as or different from the oxygen blocking layer formed over the surface of the thermoreversible recording layer opposite to a surface thereof over which the support is formed.

A method for forming the oxygen blocking layer is suitably selected from known methods without any restriction. Examples thereof include normal coating methods, and lamination methods. When the inorganic deposited layer alone is formed as the oxygen blocking layer, a PVD method, a CVD method or the like is used as the deposition method.

The thickness of the oxygen blocking layer differs depending on the oxygen permeability, but is preferably 0.005 μm to 1,000 μm, and more preferably 0.007 μm to 500 μm. The thickness is more than 1,000 μm, the transparency of the oxygen blocking layer may be decreased, and recording sensitivity may be decreased.

In the case where, as the oxygen blocking layer, the inorganic deposited film is used, the thickness of the inorganic deposited film is preferably 5 nm to 100 nm (50 Å to 1,000 Å), and more preferably 7 nm to 80 nm (70 Å to 800 Å). When the thickness is less than 5 nm (50 Å), the oxygen may be insufficiently blocked. When the thickness is more than 100 nm (1,000 Å), the oxygen blocking layer may be decreased in transparency, and colored.

Between the oxygen blocking layer and a layer adjacent to the oxygen blocking layer, an adhesive layer or a tackiness layer may be formed. A method for forming the adhesive layer or the tackiness layer is suitably selected without any restriction. Examples thereof include normal coating methods, and lamination methods.

The thickness of the adhesive layer or the tackiness layer is suitably selected depending on the intended purpose without any restriction, but is preferably 0.1 μm to 5 μm.

The material for the adhesive layer or the tackiness layer is suitably selected depending on the intended purpose without any restriction. Examples thereof include urea resins, melamine resins, phenol resins, epoxy resins, vinyl acetate resins, vinyl acetate-acrylic copolymers, ethylene-vinyl acetate copolymers, acrylic resins, polyvinyl ether resins, vinyl chloride-vinyl acetate copolymers, polystyrene resins, polyester resins, polyurethane resins, polyamide resins, chlorinated polyolefin resins, polyvinyl butyral resins, acrylic acid ester copolymers, methacrylic acid ester copolymers, natural rubbers, cyanoacrylate resins and silicone resins.

The material for the adhesive layer or the tackiness layer may be of a hot-melt type.

In the present invention, two or more inorganic deposited films are laminated so as to improve the oxygen blocking property. The inorganic deposited films are laminated using the adhesive layer or the tackiness layer.

Here, various layer configurations of the recording medium of the present invention will be described with reference to the drawings.

FIG. 1A shows a recording medium wherein a thermoreversible recording layer 2 containing the photothermal conversion material is formed on a support 1, and a first oxygen blocking layer 3*a* is formed on the thermoreversible recording layer.

Figure 1B:
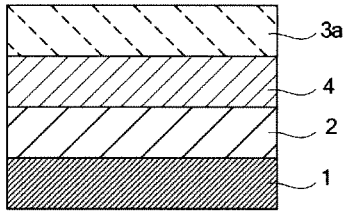
FIG. 1B shows an example of a layer configuration of a recording medium, wherein an ultraviolet absorbing layer is formed between the thermoreversible recording layer and the first oxygen blocking layer shown in FIG. 1A.

In FIG. 1B, an ultraviolet absorbing layer 4 is formed between the thermoreversible recording layer 2 and the first oxygen blocking layer 3*a* shown in FIG. 1A, so as to further improve light resistance.

Figure 1C:
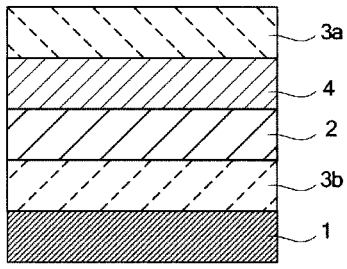
FIG. 1C shows an example of a layer configuration of a recording medium, wherein a second oxygen blocking layer is formed between the support and the thermoreversible recording layer containing the photothermal conversion material shown in FIG. 1B.

In FIG. 1C, a second oxygen blocking layer 3*b* is formed between the support 1 and the thermoreversible recording layer 2 containing the photothermal conversion material shown in FIG. 1B, so as to further block oxygen.

Figure 1D:
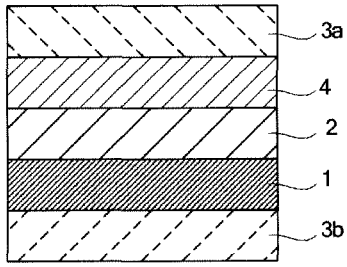
FIG. 1D shows an example of a layer configuration of a recording medium, wherein a second oxygen blocking layer is formed on a surface of the support opposite to a surface thereof on which the thermoreversible recording layer is formed shown in FIG. 1B.

In FIG. 1D, a second oxygen blocking layer 3*b* is formed on a surface of the support 1 opposite to a surface thereof on which the thermoreversible recording layer 2 is formed shown in FIG. 1B, so as to further block oxygen and to prevent the recording medium from curling.

Figure 1E:
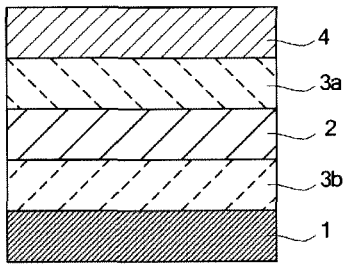
FIG. 1E shows an example of a layer configuration of a recording medium, wherein the locations of the first oxygen blocking layer and the ultraviolet absorbing layer shown in FIG. 1C are replaced with each other.

In FIG. 1E, the locations of the first oxygen blocking layer 3*a* and the ultraviolet absorbing layer 4 shown in FIG. 1C are replaced with each other, so as to suppress light degradation of the first oxygen blocking layer 3*a*.

Figure 1F:
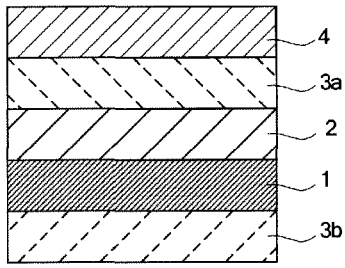
FIG. 1F shows an example of a layer configuration of a recording medium, wherein the locations of the first oxygen blocking layer and the ultraviolet absorbing layer shown in FIG. 1D are replaced with each other.

In FIG. 1F, the locations of the first oxygen blocking layer 3*a* and the ultraviolet absorbing layer 4 shown in FIG. 1D are replaced with each other, so as to suppress the light degradation of the first oxygen blocking layer 3*a*.

Figure 2A:
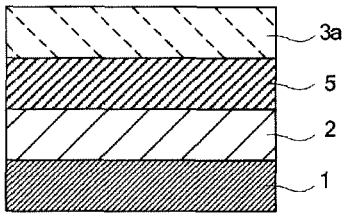
FIG. 2A shows an example of a layer configuration of a recording medium, wherein a photothermal conversion layer is formed on a thermoreversible recording layer containing no photothermal conversion material on a support, and a first oxygen blocking layer is formed on the photothermal conversion layer.

FIG. 2A shows a recording medium, wherein a photothermal conversion layer 5 containing the photothermal conversion material is formed on a thermoreversible recording layer 2 containing no photothermal conversion material on a support 1, and a first oxygen blocking layer 3*a* is formed on the photothermal conversion layer 5, so as to suppress mixture of the photothermal conversion material and the leuco dye, and to improve the light resistance of the photothermal conversion material.

Figure 2B:
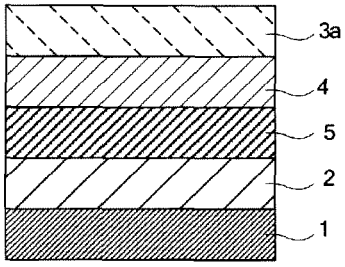
FIG. 2B shows an example of a layer configuration of a recording medium, wherein an ultraviolet absorbing layer is formed between the photothermal conversion layer and the first oxygen blocking layer shown in FIG. 2A.

In FIG. 2B, an ultraviolet absorbing layer 4 is formed between the photothermal conversion layer 5 and the first oxygen blocking layer 3*a* shown in FIG. 2A, so as to further improve light resistance.

Figure 2C:
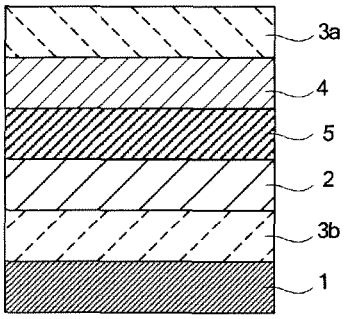
FIG. 2C shows an example of a layer configuration of a recording medium, wherein a second oxygen blocking layer is formed between the support and the thermoreversible recording layer shown in FIG. 2B.

In FIG. 2C, a second oxygen blocking layer 3*b* is formed between the support 1 and the thermoreversible recording layer 2 shown in FIG. 2B, so as to further block oxygen.

Figure 2D:
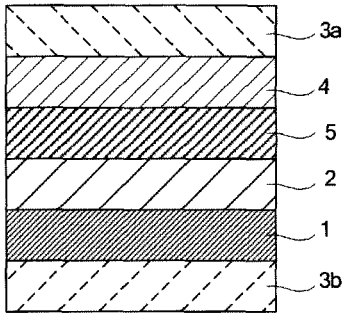
FIG. 2D shows an example of a layer configuration of a recording medium, wherein a second oxygen blocking layer is formed on a surface of the support opposite to a surface thereof on which the thermoreversible recording layer is formed shown in FIG. 2B.

In FIG. 2D, a second oxygen blocking layer 3*b* is formed on a surface of the support 1 opposite to a surface thereof on which the thermoreversible recording layer 2 is formed shown in FIG. 2B, so as to further block oxygen and to prevent the recording medium from curling.

Figure 2E:
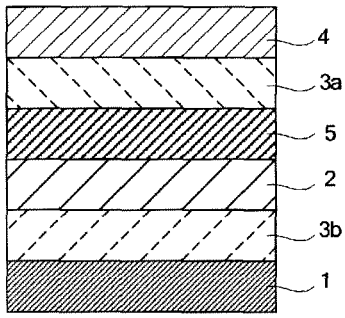
FIG. 2E shows an example of a layer configuration of a recording medium, wherein the locations of the first oxygen blocking layer and the ultraviolet absorbing layer shown in FIG. 2C are replaced with each other.

In FIG. 2E, the locations of the first oxygen blocking layer 3*a* and the ultraviolet absorbing layer 4 shown in FIG. 2C are replaced with each other, so as to suppress the light degradation of the first oxygen blocking layer 3*a*.

Figure 2F:
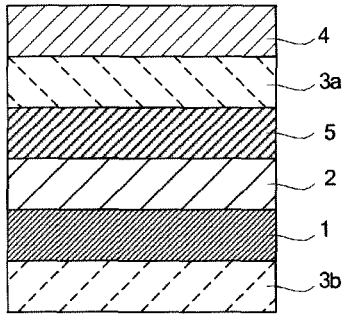
FIG. 2F shows an example of a layer configuration of a recording medium, wherein the locations of the first oxygen blocking layer and the ultraviolet absorbing layer shown in FIG. 2D are replaced with each other.

In FIG. 2F, the locations of the first oxygen blocking layer 3*a* and the ultraviolet absorbing layer 4 shown in FIG. 2D are replaced with each other, so as to suppress the light degradation of the first oxygen blocking layer 3*a*.

Additionally, in FIGS. 2A to 2F, the locations of the thermoreversible recording layer 2 and the photothermal conversion layer 5 may be replaced with each other.

Figure 3A:
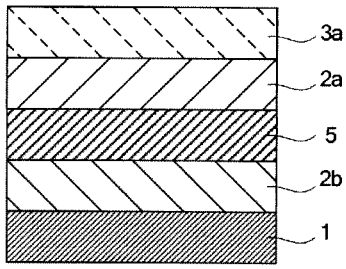
FIG. 3A shows an example of a layer configuration of a recording medium, wherein a photothermal conversion layer containing a photothermal conversion material is formed on a second thermoreversible recording layer containing no photothermal conversion material on the support, a first thermoreversible recording layer containing no photothermal conversion material is further formed on the photothermal conversion layer, and a first oxygen blocking layer is formed on the first thermoreversible recording layer.

FIG. 3A shows a recording medium, wherein a photothermal conversion layer 5 containing the photothermal conversion material is formed on a second thermoreversible recording layer 2*b* containing no photothermal conversion material on a support 1, a first thermoreversible recording layer 2*a* containing no photothermal conversion material is further formed on the photothermal conversion layer 5, and a first oxygen blocking layer 3*a* is formed on the first thermoreversible recording layer 2*a*, so as to effectively use heat generated in the photothermal conversion layer 5, thereby obtaining excellent recording sensitivity.

Figure 3B:
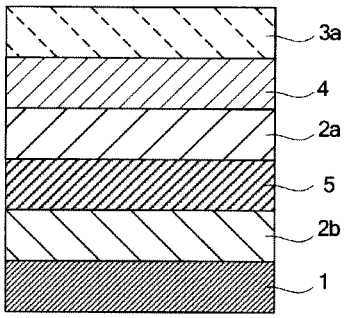
FIG. 3B shows an example of a layer configuration of a recording medium, wherein an ultraviolet absorbing layer is formed between the first thermoreversible recording layer and the first oxygen blocking layer over the photothermal conversion layer shown in FIG. 3A.

In FIG. 3B, an ultraviolet absorbing layer 4 is formed between the first thermoreversible recording layer 2*a* and the first oxygen blocking layer 3*a* over the photothermal conversion layer 5 shown in FIG. 3A, so as to further improve the light resistance.

Figure 3C:
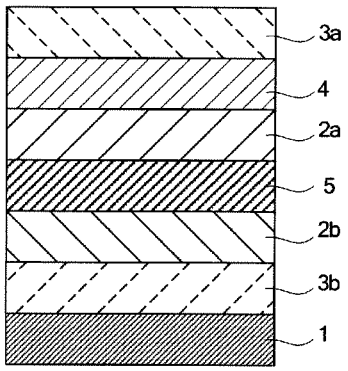
FIG. 3C shows an example of a layer configuration of a recording medium, wherein a second oxygen blocking layer is formed between the support and the second thermoreversible recording layer shown in FIG. 3B.

In FIG. 3C, a second oxygen blocking layer 3*b* is formed between the support 1 and the second thermoreversible recording layer 2*b* shown in FIG. 3B, so as to further block oxygen.

Figure 3D:
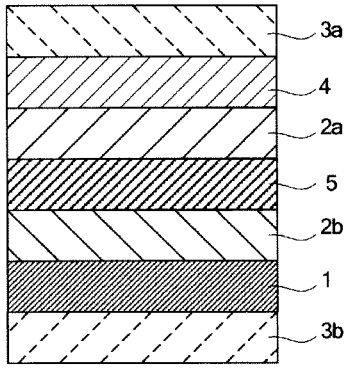
FIG. 3D shows an example of a layer configuration of a recording medium, wherein the second oxygen blocking layer is formed on a surface of the support opposite to a surface thereof on which the second thermoreversible recording layer is formed shown in FIG. 3B.

In FIG. 3D, the second oxygen blocking layer 3*b* is formed on a surface of the support 1 opposite to a surface thereof on which the second thermoreversible recording layer 2*b* is formed shown in FIG. 3B, so as to further block oxygen and to prevent the recording medium from curling.

Figure 3E:
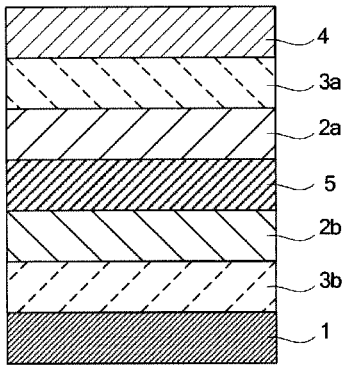
FIG. 3E shows an example of a layer configuration of a recording medium, wherein the locations of the first oxygen blocking layer and the ultraviolet absorbing layer shown in FIG. 3C are replaced with each other.

In FIG. 3E, the locations of the first oxygen blocking layer 3*a* and the ultraviolet absorbing layer 4 shown in FIG. 3C are replaced with each other, so as to suppress the light degradation of the first oxygen blocking layer 3*a*.

Figure 3F:
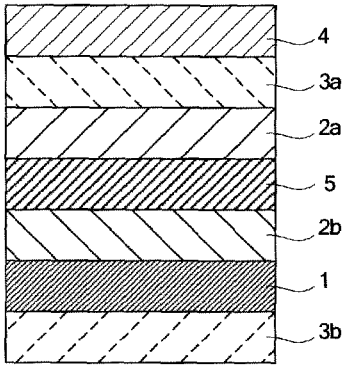
FIG. 3F shows an example of a layer configuration of a recording medium, wherein the locations of the first oxygen blocking layer and the ultraviolet absorbing layer shown in FIG. 3D are replaced with each other.

In FIG. 3F, the locations of the first oxygen blocking layer 3*a* and the ultraviolet absorbing layer 4 shown in FIG. 3D are replaced with each other, so as to suppress the light degradation of the first oxygen blocking layer 3*a*.

Figure 4A:
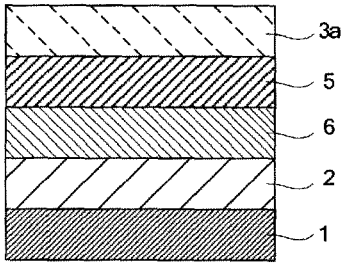
FIG. 4A shows an example of a layer configuration of a recording medium, wherein an intermediate layer is formed between the thermoreversible recording layer and the photothermal conversion layer shown in FIG. 2A.

FIG. 4A is a recording medium, wherein an intermediate layer 6 is formed between the thermoreversible recording layer 2 and the photothermal conversion layer 5 shown in FIG. 2A, so as to suppress the mixture of the photothermal conversion material and the leuco dye due to repetitive image recording and erasing, thereby improving the light resistance of the photothermal conversion material.

Figure 4B:
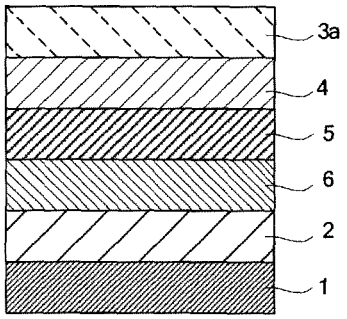
FIG. 4B shows an example of a layer configuration of a recording medium, wherein an ultraviolet absorbing layer is formed between the photothermal conversion layer and the first oxygen blocking layer shown in FIG. 4A.

In FIG. 4B, an ultraviolet absorbing layer 4 is formed between the photothermal conversion layer 5 and the first oxygen blocking layer 3*a* shown in FIG. 4A, so as to further improve the light resistance.

Figure 4C:
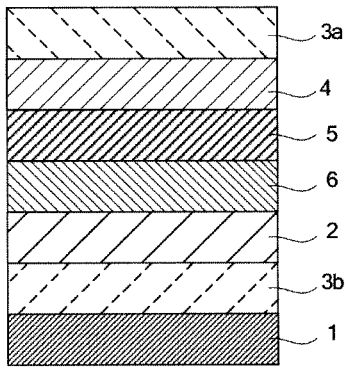
FIG. 4C shows an example of a layer configuration of a recording medium, wherein a second oxygen blocking layer is formed between the support and the thermoreversible recording layer shown in FIG. 4B.

In FIG. 4C, a second oxygen blocking layer 3*b* is formed between the support 1 and the thermoreversible recording layer 2 shown in FIG. 4B, so as to further block oxygen.

Figure 4D:
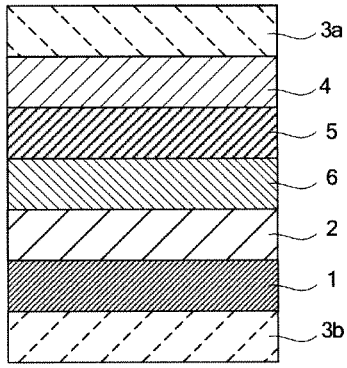
FIG. 4D shows an example of a layer configuration of a recording medium, wherein a second oxygen blocking layer is formed on a surface of the support opposite to a surface thereof on which the thermoreversible recording layer is formed shown in FIG. 4B.

In FIG. 4D, a second oxygen blocking layer 3*b* is formed on a surface of the support 1 opposite to a surface thereof on which the thermoreversible recording layer 2 is formed shown in FIG. 4B, so as to further block oxygen and to prevent the recording medium from curling.

Figure 4E:
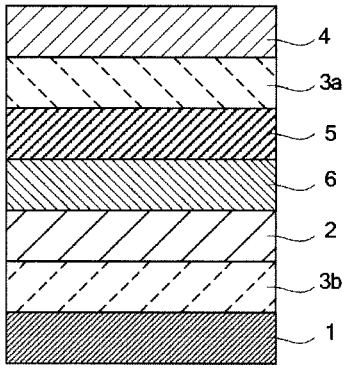
FIG. 4E shows an example of a layer configuration of a recording medium, wherein the locations of the first oxygen blocking layer and the ultraviolet absorbing layer shown in FIG. 4C are replaced with each other.

In FIG. 4E, the locations of the first oxygen blocking layer 3*a* and the ultraviolet absorbing layer 4 shown in FIG. 4C are replaced with each other, so as to suppress the light degradation of the first oxygen blocking layer 3*a*.

Figure 4F:
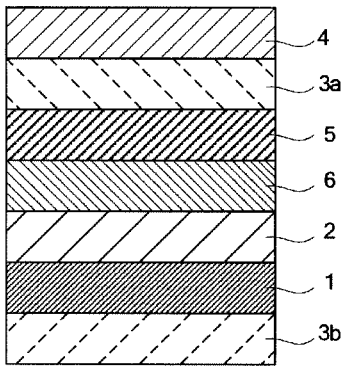
FIG. 4F shows an example of a layer configuration of a recording medium, wherein the locations of the first oxygen blocking layer and the ultraviolet absorbing layer shown in FIG. 4D are replaced with each other.

In FIG. 4F, the locations of the first oxygen blocking layer 3*a* and the ultraviolet absorbing layer 4 shown in FIG. 4D are replaced with each other, so as to suppress the light degradation of the first oxygen blocking layer 3*a*.

Additionally, in FIG. 4A to FIG. 4F, the locations of the thermoreversible recording layer 2 and the photothermal conversion layer 5 may be replaced with each other.

Figure 5A:
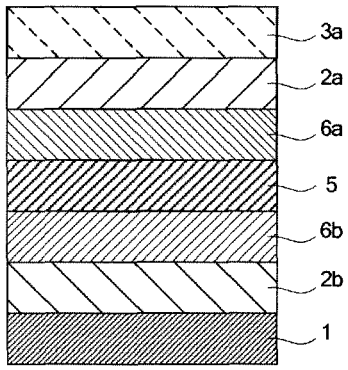
FIG. 5A shows an example of a layer configuration of a recording medium, wherein a first intermediate layer is formed between the first thermoreversible recording layer and the photothermal conversion layer, and a second intermediate layer is formed between the second thermoreversible recording layer and the photothermal conversion layer in the recording medium shown in FIG. 3A.

FIG. 5A is a recording medium, wherein a first intermediate layer 6*a* is formed between the first thermoreversible recording layer 2*a* and the photothermal conversion layer 5, and a second intermediate layer 6*b* is formed between the second thermoreversible recording layer 2*b* and the photothermal conversion layer 5 in the recording medium shown in FIG. 3A, so as to suppress the mixture of the photothermal conversion material and the leuco dye due to repetitive image recording and erasing, thereby improving the light resistance of the photothermal conversion material, and so as to effectively use heat generated in the photothermal conversion layer 5, thereby obtaining excellent recording sensitivity.

Figure 5B:
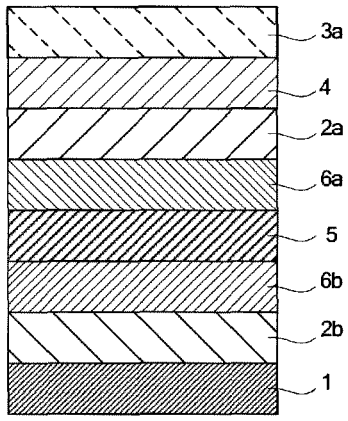
FIG. 5B shows an example of a layer configuration of a recording medium, wherein an ultraviolet absorbing layer is formed between the first thermoreversible recording layer and the first oxygen blocking layer over the first intermediate layer shown in FIG. 5A.

In FIG. 5B, an ultraviolet absorbing layer 4 is formed between the first thermoreversible recording layer 2*a* and the first oxygen blocking layer 3*a* over the first intermediate layer 6*a* shown in FIG. 5A, so as to further improve the light resistance.

Figure 5C:
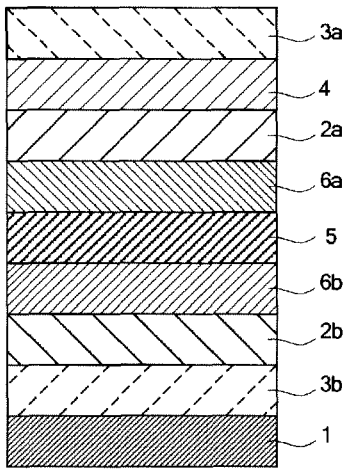
FIG. 5C shows an example of a layer configuration of a recording medium, wherein a second oxygen blocking layer is formed between the support and the second thermoreversible recording layer shown in FIG. 5B.

In FIG. 5C, a second oxygen blocking layer 3*b* is formed between the support 1 and the second thermoreversible recording layer 2*b* shown in FIG. 5B, so as to further block oxygen.

Figure 5D:
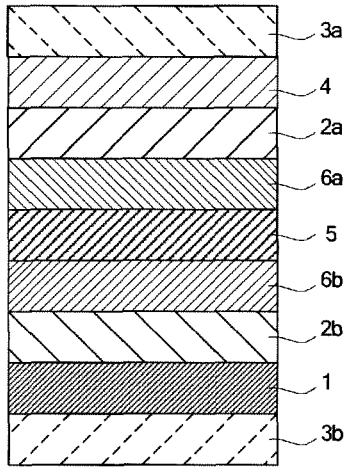
FIG. 5D shows an example of a layer configuration of a recording medium, wherein a second oxygen blocking layer is formed on a surface of the support opposite to a surface thereof on which the thermoreversible recording layer is formed shown in FIG. 5B.

In FIG. 5D, a second oxygen blocking layer 3*b* is formed on a surface of the support 1 opposite to a surface thereof on which the second thermoreversible recording layers 2*b* is formed shown in FIG. 5B, so as to further block oxygen and to prevent the recording medium from curling.

Figure 5E:
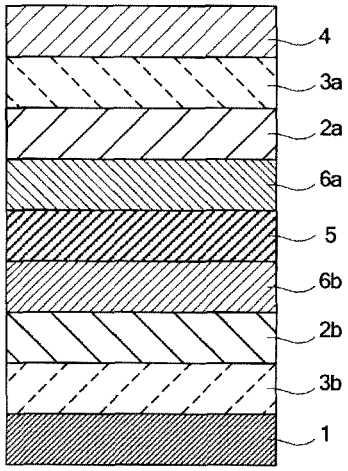
FIG. 5E shows an example of a layer configuration of a recording medium, wherein the locations of the first oxygen blocking layer and the ultraviolet absorbing layer shown in FIG. 5C are replaced with each other.

In FIG. 5E, the locations of the first oxygen blocking layer 3*a* and the ultraviolet absorbing layer 4 shown in FIG. 5C are replaced with each other, so as to suppress the light degradation of the first oxygen blocking layer 3*a*.

Figure 5F:
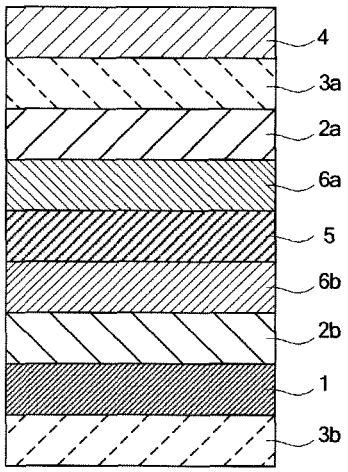
FIG. 5F shows an example of a layer configuration of a recording medium, wherein the locations of the first oxygen blocking layer and the ultraviolet absorbing layer shown in FIG. 5D are replaced with each other.

In FIG. 5F, the locations of the first oxygen blocking layer 3*a* and the ultraviolet absorbing layer 4 shown in FIG. 5D are replaced with each other, so as to suppress the light degradation of the first oxygen blocking layer 3*a*.

Figure 6:
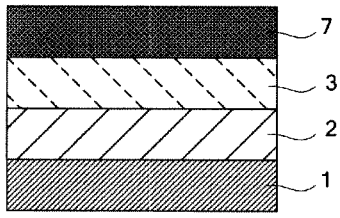
FIG. 6 shows an example of a layer configuration of a recording medium, wherein a protective layer is formed on the oxygen blocking layer in the recording medium shown in FIG. 1A.

FIG. 6 is a recording medium, wherein over the support 1 a thermoreversible recording layer 2 containing a photothermal conversion material, an oxygen blocking layer 3 and a protective layer 7 are formed in this order. The configuration of the protective layer 7 is not limited to that shown in FIG. 6, and can be used in any configuration so as to protect the thermoreversible recording layer, the photothermal conversion layer, the ultraviolet absorbing layer, and the oxygen blocking layer. Moreover, layers other than those mentioned above, such as an adhesive layer may be formed in order to improve adhesion between these layers.

<Support>

The shape, structure, size and the like of the support are suitably selected depending on the intended purpose without any restriction. Examples of the shape include plate-like shapes; the structure may be a single-layer structure or a laminated structure; and the size may be suitably selected according to the size of the recording medium, etc.

Examples of the material for the support include inorganic materials and organic materials.

Examples of the inorganic materials include glass, quartz, silicon, silicon oxide, aluminum oxide, $SiO_2$ and metals.

Examples of the organic materials include paper, cellulose derivatives such as cellulose triacetate, synthetic paper, and films made of polyethylene terephthalate, polycarbonates, polystyrene, polymethyl methacrylate, etc.

Each of the inorganic materials and the organic materials may be used alone or in combination. Among these materials, the organic materials are preferable, specifically films made of polyethylene terephthalate, polycarbonates, polymethyl methacrylate, etc. are preferable. Of these, polyethylene terephthalate is particularly preferable.

It is desirable that the support be subjected to surface modification by means of corona discharge, oxidation reaction (using chromic acid, for example), etching, facilitation of adhesion, antistatic treatment, etc. for the purpose of improving the adhesiveness of a coating layer.

Also, it is desirable to color the support white by adding, for example, a white pigment such as titanium oxide to the support.

The thickness of the support is suitably selected depending on the intended purpose without any restriction, with the range of 10 μm to 2,000 μm being preferable and the range of 50 μm to 1,000 μm being more preferable.

<Thermoreversible Recording Layer>

The thermoreversible recording layer (which may be hereinafter referred to simply as "recording layer") includes a leuco dye serving as an electron-donating color-forming compound and a developer serving as an electron-accepting compound, in which color tone reversibly changes by heat, and further includes other components in accordance with the necessity.

The leuco dye serving as an electron-donating color-forming compound and reversible developer serving as an electron-accepting compound, in which color tone reversibly changes by heat are materials capable of exhibiting a phenomenon in which visible changes are reversibly produced by temperature change; and the material can relatively change into a colored state and into a decolored state, depending upon the heating temperature and the cooling rate after heating.

The leuco dye is a dye precursor which is colorless or pale per se. The leuco dye is suitably selected from known leuco dyes without any restriction. Examples thereof include leuco compounds based upon triphenylmethane phthalide, triallylmethane, fluoran, phenothiazine, thiofluoran, xanthene, indophthalyl, spiropyran, azaphthalide, chromenopyrazole, methines, rhodamineanilinolactam, rhodaminelactam, quinazoline, diazaxanthene and bislactone. Among these, leuco dyes based upon fluoran and phthalide are particularly preferable in that they are excellent in coloring and decoloring property, colorfulness and storage ability. Each of these may be used alone or in combination, and the recording medium can be made suitable for multicolor or full-color recording by providing a layer which color forms with a different color tone.

The reversible developer is suitably selected depending on the intended purpose without any restriction, provided that it is capable of reversibly developing and erasing color by means of heat. Suitable examples thereof include a compound having in its molecules at least one of the following structures: a structure (1) having such a color-developing ability as makes the leuco dye develop color (for example, a phenolic hydroxyl group, a carboxylic acid group, a phosphoric acid group, etc.); and a structure (2) which controls cohesion among molecules (for example, a structure in which long-chain hydrocarbon groups are linked together). The bonding site may be bonded via a divalent or higher bond group containing a hetero atom. Additionally, the long-chain hydrocarbon groups may contain at least either similar linking groups or aromatic groups.

For the structure (1) having such a color-developing ability as makes the leuco dye develop color, phenol is particularly suitable.

For the structure (2) which controls cohesion among molecules, long-chain hydrocarbon groups having 8 or more carbon atoms, preferably 11 or more carbon atoms, are suitable, and the upper limit of the number of carbon atoms is preferably 40 or less, more preferably 30 or less.

Of the reversible developers, a phenol compound expressed by General Formula (1) is preferable, and a phenol compound expressed by General Formula (2) is more preferable.

General Formula (1)

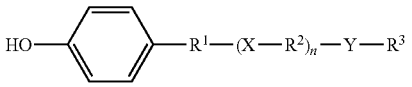

General Formula (2)

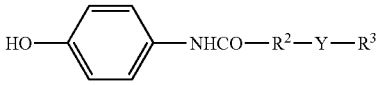

In General Formulae (1) and (2), $R^1$ denotes a single bond or an aliphatic hydrocarbon group having 1 to 24 carbon atoms. $R^2$ denotes an aliphatic hydrocarbon group having two or more carbon atoms, which may have a substituent, and the number of the carbon atoms is preferably 5 or greater, more preferably 10 or greater. $R^3$ denotes an aliphatic hydrocarbon group having 1 to 35 carbon atoms, and the number of the carbon atoms is preferably 6 to 35, more preferably 8 to 35. Each of these aliphatic hydrocarbon groups may be provided alone or in combination.

The sum of the numbers of carbon atoms which $R^1$, $R^2$ and $R^3$ have is suitably selected depending on the intended purpose without any restriction, with its lower limit being preferably 8 or greater, more preferably 11 or greater, and its upper limit being preferably 40 or less, more preferably 35 or less.

When the sum of the numbers of carbon atoms is less than 8, coloring stability or decoloring ability may degrade.

Each of the aliphatic hydrocarbon groups may be a straight-chain group or a branched-chain group and may have an unsaturated bond, with preference being given to a straight-chain group. Examples of the substituent bonded to the aliphatic hydrocarbon group include a hydroxyl group, halogen atoms and alkoxy groups.

X and Y may be identical or different, each denoting an N atom-containing or O atom-containing divalent group. Specific examples is thereof include an oxygen atom, amide group, urea group, diacylhydrazine group, diamide oxalate group and acylurea group, with amide group and urea group being preferable.

"n" denotes an integer of 0 to 1.

It is desirable that the electron-accepting compound (developer) be used together with a compound as a color erasure accelerator having in its molecules at least one of —NHCO— group and —OCONH— group because intermolecular interaction is induced between the color erasure accelerator and the developer in a process of producing a decolored state and thus there is an improvement in coloring and decoloring property.

The color erasure accelerator is suitably selected depending on the intended purpose without any restriction.

For the thermoreversible recording layer, a binder resin and, if necessary, additives for improving or controlling the coating properties and coloring and decoloring properties of the thermoreversible recording layer may be used. Examples of these additives include a surfactant, a conductive agent, a filler, an antioxidant, a light stabilizer, a coloring stabilizer, a color erasure accelerator and a plasticizer.

The binder resin is suitably selected depending on the intended purpose without any restriction, provided that it enables the thermoreversible recording layer to be bonded onto the support. For instance, one of conventionally known resins or a combination of two or more thereof may be used for the binder resin. Among these resins, resins capable of being crosslinked by heat, an ultraviolet ray, an electron beam or the like are preferable, with particular preference being given to resins each containing an isocyanate compound or the like as a cross-linking agent, in order to improve the durability at the time of repeated use and to prevent gas generation by thermal decomposition of the resin component around the photothermal conversion material and the photothermal conversion material itself due to heating at the time of repeated use, in the case where the photothermal conversion material is contained in the recording layer.

Examples of the binder resins include a resin having a group which reacts with a cross-linking agent, such as a hydroxyl group or carboxyl group, and a resin produced by copolymerizing a hydroxyl group-containing or carboxyl group-containing monomer and other monomer. Specific examples of such resins include phenoxy resins, polyvinyl butyral resins, cellulose acetate propionate resins, cellulose acetate butyrate resins, acrylpolyol resins, polyester polyol resins and polyurethane polyol resins, with particular preference being given to acrylpolyol resins, polyester polyol resins and polyurethane polyol resins.

The binder resin preferably has a hydroxyl value of 50 mgKOH/g to 400 mgKOH/g, and more preferably 100 mgKOH/g to 350 mgKOH/g, in terms of adequate coating strength and excellent solubility in an organic solvent. When the hydroxyl value is less than 50 mgKOH/g, the adequate coating strength cannot be obtained, and the recording medium may be easily degraded by repeatedly performing image erasing, and the resin component around the photothermal conversion material and the photothermal conversion material itself may be easily thermally decomposed into gas. On the other hand, when the hydroxyl value is more than 400 mgKOH/g, the binder resin cannot completely cross-link a film, and a non-cross-linked component adversely affects a coloring system. Moreover, the solubility in an organic solvent is decreased, and the binder resin cannot be completely dissolved in the organic solvent in some cases.

The mixture ratio (mass ratio) of the color former to the binder resin in the thermoreversible recording layer is preferably in the range of 1:0.1 to 1:10. When the amount of the binder resin is too small, the thermoreversible recording layer may be deficient in thermal strength. When the amount of the binder resin is too large, it is problematic because the coloring density decreases.

The cross-linking agent is suitably selected depending on the intended purpose without any restriction, and examples thereof include isocyanates, amino resins, phenol resins, amines and epoxy compounds. Among these, isocyanates are preferable, and polyisocyanate compounds each having a plurality of isocyanate groups are particularly preferable.

As to the amount of the cross-linking agent added in relation to the amount of the binder resin, the ratio of the number of functional groups contained in the cross-linking agent to the number of active groups contained in the binder resin is preferably in the range of 0.01:1 to 5:1. When the amount of the cross-linking agent added is so small as to be outside this range, sufficient thermal strength cannot be obtained. When the amount of the cross-linking agent added is so large as to be outside this range, there is an adverse effect on the coloring and decoloring properties.

Further, as a cross-linking accelerator, a catalyst utilized in this type of reaction may be used.

The gel fraction of the resin, which is thermally cross-linked, is preferably 30% or greater, more preferably 50% or greater, even more preferably 70% or greater. When the gel fraction is less than 30%, an adequate cross-linked state cannot be produced, and thus there may be degradation of durability.

As to a method for distinguishing between a cross-linked state to and a non-cross-linked state of the binder resin, these two states can be distinguished by immersing a coating film in a solvent having high dissolving ability, for example, MEK, THF or the like. Specifically, with respect to the binder resin in a non-cross-linked state, the resin dissolves in the solvent and thus does not remain in a solute.

The above-mentioned other components in the thermoreversible recording layer are suitably selected depending on the intended purpose without any restriction. For instance, a surfactant, a plasticizer and the like are suitable therefor in that recording of an image can be facilitated.

To a solvent, a coating solution dispersing device, a recording layer applying method, a drying and crosslinking method and the like used for the thermoreversible recording layer coating solution, those known can be used.

To prepare the thermoreversible recording layer coating solution, materials may be together dispersed into a solvent using the dispersing device; alternatively, the materials may be independently dispersed into respective solvents and then the solutions may be mixed together. Further, the materials may be heated and dissolved, and then they may be precipitated by rapid cooling or slow cooling.

The method for forming the thermoreversible recording layer is suitably selected depending on the intended purpose without any restriction. Suitable examples thereof include a method (1) of applying onto a support a thermoreversible recording layer coating solution in which the resin, the electron-donating color-forming compound and the electron-accepting compound are dissolved or dispersed in a solvent, then cross-linking the coating solution while or after forming it into a sheet or the like by evaporation of the solvent; a method (2) of applying onto a support a thermoreversible recording layer coating solution in which the electron-donating color-forming compound and the electron-accepting compound are dispersed in a solvent in which only the resin is dissolved, then cross-linking the coating solution while or after forming it into a sheet or the like by evaporation of the solvent; and a method (3) of not using a solvent and heating and melting the resin, the electron-donating color-forming compound and the electron-accepting compound so as to mix, then cross-linking this melted mixture after forming it into a sheet or the like and cooling it. In each of these methods, it is also possible to produce a recording medium in the form of a sheet without using the support.

The solvent used in (1) or (2) cannot be unequivocally defined, as it is affected by the types, etc. of the resin, the electron-donating color-forming compound and the electron-accepting compound. Examples thereof include tetrahydrofuran, methyl ethyl ketone, methyl isobutyl ketone, chloroform, carbon tetrachloride, ethanol, toluene and benzene.

Additionally, the electron-accepting compound is present in the thermoreversible recording layer, being dispersed in the form of particles.

A pigment, an antifoaming agent, a dispersant, a slip agent, an antiseptic agent, and the like may be added into the thermoreversible recording layer coating solution, for the purpose of exhibiting high performance as a coating material.

The coating method for the thermoreversible recording layer is suitably selected depending on the intended purpose without any restriction. For instance, a support which is continuous in the form of a roll or which has been cut into the form of a sheet is conveyed, and the support is coated with the recording layer by a known method such as blade coating, wire bar coating, spray coating, air knife coating, bead coating, curtain coating, gravure coating, kiss coating, reverse roll coating, dip coating or die coating.

The drying conditions of the thermoreversible recording layer coating solution are suitably selected depending on the intended purpose without any restriction. For instance, the thermoreversible recording layer coating solution is dried at room temperature to a temperature of 140° C., for approximately 10 sec to 10 min.

The thickness of the thermoreversible recording layer is suitably selected depending on the intended purpose without any restriction. For instance, it is preferably 1 μm to 20 μm, more preferably 3 μm to 15 μm. When the thermoreversible recording layer is too thin, the contrast of an image may lower because the coloring density lowers. When the recording layer is too thick, the heat distribution in the layer increases, a portion which does not reach a coloring temperature and so does not form color is created, and thus a desired coloring density may be unable to be obtained.

In the case where a first thermoreversible recording layer and a second thermoreversible recording layer are formed, the total thickness of the first thermoreversible recording layer and the second thermoreversible recording layer is the thickness of the thermoreversible recording layer as described above. The thickness of the first thermoreversible recording layer is preferably, 0.1 μm to 15 μm, and the thickness of the second thermoreversible recording layer is preferably 0.1 μm to 15 μm.

According to the present invention, the photothermal conversion material added in the thermoreversible recording layer is broadly classified into inorganic materials and organic materials.

Examples of the inorganic materials include carbon black, metals such as Ge, Bi, In, Te, Se, and Cr, or semi-metals thereof and compounds containing them. Each of these inorganic materials is formed into a layer form by vacuum evaporation method or by bonding a particulate material using a resin or the like.

For the organic material, various dyes can be suitably used in accordance with the wavelength of light to be absorbed, and a near-infrared absorption pigment having an absorption peak near wavelengths of 600 nm to 1,200 nm is used, when a semiconductor laser is used as a light source. Specific examples of the near infrared absorption pigment include cyanine pigments, quinone, quinoline derivatives of indonaphthol, phenylene diamine nickel complexes, and phthalocyanine pigments. To perform repetitive image processing, it is preferable to select a photothermal conversion material that is excellent in heat resistance, with particular preference being given to phthalocyanine pigments.

Each of the near-infrared absorption pigments may be used alone or in combination. The amount of the photothermal conversion material is preferably 1 mg/m$^2$ to 200 mg/m$^2$, and more preferably 5 mg/m$^2$ to 100 mg/m$^2$. When the amount is less than 1 mg/m$^2$, adequate image density cannot be obtained. When the amount is more than 200 mg/m$^2$, since the photothermal conversion material has a slight absorption peak in the visible range, the background coloring increases, decreasing image contrast.

<Photothermal Conversion Layer>

In the present invention, in the case where the thermoreversible recording layer contains a leuco dye and a reversible developer, the photothermal conversion material is added in the thermoreversible recording layer, and it may interact with the leuco dye to thereby cause decrease in the light resistance of the photothermal conversion material. In that case, the photothermal conversion layer is preferably formed adjacent to the thermoreversible recording layer. The photothermal conversion layer contains at least the photothermal conversion material and the binder resin.

As the binder resin used in the photothermal conversion layer, resins capable of being cured by heat, an ultraviolet ray, an electron beam or the like are preferable in order to improve the durability at the time of repeated use and to prevent gasification by thermal decomposition of the resin component around the photothermal conversion material and the photothermal conversion material itself due to heating at the time of repeated use, and the resin similar to the cross-linkable binder resins used in the thermoreversible recording layer can be preferably used. Examples of the crosslinkable binder resins include a resin having a group which reacts with a cross-linking agent, such as a hydroxyl group or carboxyl group, and a resin produced by copolymerizing a hydroxyl group-containing or carboxyl group-containing monomer and other monomer. Specific examples of such resins include phenoxy resins, polyvinyl butyral resins, cellulose acetate propionate resins, cellulose acetate butyrate resins, acrylpolyol resins, polyester polyol resins and polyurethane polyol resins, with particular preference being given to acrylpolyol resins, polyester polyol resins and polyurethane polyol resins, in terms of the adhesion to the recording layer. Particularly, thermally cross-linkable resins using a cross-linking agent, such as an isocyanate compound are preferred. The binder resin preferably has a hydroxyl value of 50 mgKOH/g to 400 mgKOH/g, and more preferably 100 mgKOH/g to 350 mgKOH/g, in terms of adequate coating strength and excellent solubility in an organic solvent. When the hydroxyl value is less than 50 mgKOH/g, the adequate coating strength cannot be obtained, and the recording medium may be easily degraded by repeatedly performing image erasing, and the resin component around the photothermal conversion material and the photothermal conversion material itself may be easily thermally decomposed into gas. On the other hand, when the hydroxyl value is more than 400 mgKOH/g, the binder resin cannot completely cross-link a film, and a non-cross-linked component adversely affects a coloring system. Moreover, the solubility in an organic solvent is decreased, and the binder resin cannot be completely dissolved in the organic solvent in some cases.

The mixture ratio (mass ratio) of the photothermal conversion material to the binder resin in the photothermal conversion layer is preferably in the range of 0.1:0.1 to 0.1:100, because the background coloring caused by the presence of the photothermal conversion material less occurs, recording sensitivity is excellent, and adequate coating strength can be obtained. When the amount of the binder resin is too small, the photothermal conversion layer may be deficient in thermal strength. When the amount of the binder resin is too large, it is problematic because the recording sensitivity decreases.

The cross-linking agent is suitably selected depending on the intended purpose without any restriction, and examples thereof include isocyanates, amino resins, phenol resins, amines and epoxy compounds. Of these, isocyanates are preferable, and polyisocyanate compounds each having a plurality of isocyanate groups are particularly preferable.

As to the amount of the cross-linking agent added in relation to the amount of the binder resin, the ratio of the number of functional groups contained in the cross-linking agent to the number of active groups contained in the binder resin is preferably in the range of 0.1:1 to 5:1. When the amount of the cross-linking agent added is so small as to be outside this range, sufficient thermal strength cannot be obtained, and gas is easily generated by thermal decomposition of the resin component around the photothermal conversion material and the photothermal conversion material itself. When the amount of the cross-linking agent added is so large as to be outside this range, cross-linking reaction takes a long time, adversely affecting, such as blocking.

Further, as a cross-linking accelerator, a catalyst utilized in this kind of reaction may be used.

The gel fraction of the resin, which is thermally cross-linked, is preferably 30% or greater, more preferably 50% or greater, even more preferably 70% or greater.

As to a method for distinguishing between a cross-linked state and a non-cross-linked state of the binder resin, for example, these two states can be distinguished by immersing a coating film in a solvent having high dissolving ability in the same as the above-described thermoreversible recording layer.

Other components in the photothermal conversion layer is suitably selected depending on the intended purpose without any restriction. Various known additives, pigments or the like may be added.

To a solvent, a coating solution dispersing device, an applying method, a drying and hardening method and the like used for the photothermal conversion layer coating solution, those known can be used.

The thickness of the photothermal conversion layer is suitably selected depending on the intended purpose without any restriction. It is preferably 0.1 μm to 30 μm, and more preferably 0.5 μm to 20 μm.

In the case where the photothermal conversion layer is provided, the photothermal conversion layer may be formed in one side of the thermoreversible recording layer. However, thermoreversible recording layers are preferably formed in both sides of the photothermal conversion layer. The photothermal conversion layer is sandwiched by the thermoreversible recording layers, so that heat generated in the photothermal conversion layer can be effectively used. Thus, the recording sensitivity is improved to the same degree as that obtained when the photothermal conversion material is contained in the thermoreversible recording layer. The thickness of the thermoreversible recording layer is suitably selected depending on the intended purpose without any restriction. The thermoreversible recording layers in both sides of the photothermal conversion layer have the same or different thickness. It is preferred that the thermoreversible recording layer formed over the side of the photothermal conversion layer opposite to the side where the support is formed be thicker than the thermoreversible recording layer formed over the photothermal conversion layer in the side where the support is formed.

<Intermediate Layer>

In the present invention, in the case where the photothermal conversion layer is formed, an intermediate layer is preferably formed between the photothermal conversion layer and the thermoreversible recording layer, so as to prevent the photothermal conversion material and the leuco dye from mixing due to an application of the photothermal conversion layer or the thermoreversible recording layer, to prevent the photothermal conversion material from transferring to the thermoreversible recording layer due to repetitive image recording and erasing, and to prevent the leuco dye from transferring to the photothermal conversion layer. The formation of the intermediate layer can reduce the decrease in light resistance caused by interaction between the photothermal conversion material and the leuco dye.

The intermediate layer contains at least a binder resin and further contains other components such as a filler, a lubricant in accordance with the necessity.

The binder resin used in the intermediate layer is suitably selected from known binder resins depending on the intended purpose without any restriction. The resins such as binder resins, thermoplastic resins or thermosetting resins, which are used in the thermoreversible recording layer or the photothermal conversion layer, can be used. Of these resins, resins capable of being cross-linked by heat, an ultraviolet ray, an electron beam or the like, or high heat resistance resins soluble in a solvent are preferably used in order to improve the durability at the time of repeated use. Specific examples of such resins include phenoxy resins, polyvinyl butyral resins, cellulose acetate propionate resins, cellulose acetate butyrate resins, acrylpolyol resins, polyester polyol resins and polyurethane polyol resins, polyarylate resins, polyimide resins, with particular preference being given to acrylpolyol resins, polyester polyol resins and polyurethane polyol resins, in term of the adhesion to the thermoreversible recording layer and the photothermal conversion layer.

The thickness of the intermediate layer is preferably 0.1 μm to 20 μm, more preferably 0.2 μm to 5 μm. To a solvent, a coating solution dispersing device, an applying method, an intermediate layer drying and cross-linking method and the like used for the intermediate layer coating solution, those known are used.

<Ultraviolet Absorbing Layer>

In the present invention, an ultraviolet absorbing layer is preferably formed over a surface of the thermoreversible recording layer opposite to a surface thereof over which the support is formed, so as to prevent the leuco dye in the thermoreversible recording layer or the photothermal conversion material in the thermosensitive recording layer from decomposition by ultraviolet light. Thus, the light resistance of the recording medium can be improved.

The ultraviolet absorbing layer contains at least an ultraviolet absorber, and further contains other components such as a binder resin, a filler, a lubricant, a coloring pigment, and the like.

The binder resin is suitably selected depending on the intended purpose without any restriction. For the binder resin, the binder resins used for the thermoreversible recording layer or resin components such as thermoplastic resins or thermosetting resins may be used. Examples of the resin components include polyethylene, polypropylene, polystyrene, polyvinyl alcohol, polyvinyl butyral, polyurethane, saturated polyesters, unsaturated polyesters, epoxy resins, phenol resins, acrylic polyol resins, polyester polyol resins, polyurethane polyol resins, polycarbonates and polyamides.

As the ultraviolet absorber, any one of an organic compound and an inorganic compound may be used.

A polymer having an ultraviolet absorbing structure (hereinafter otherwise referred to as "ultraviolet absorbing polymer") is preferably used in terms of stability of ultraviolet absorption performance during long term storage.

Here, the polymer having an ultraviolet absorbing structure denotes a polymer having an ultraviolet absorbing structure (e.g. ultraviolet absorbing group) in its molecules. Examples of the ultraviolet absorbing structure include salicylate structure, cyanoacrylate structure, benzotriazole structure and benzophenone structure, with particular preference being given to benzotriazole structure and benzophenone structure, because they absorb the ultraviolet light having a wavelength of 340 nm to 400 nm, which causes the light degradation of the leuco dye.

It is desirable that the ultraviolet absorbing polymer be cross-linked. Accordingly, the ultraviolet absorbing polymer is preferably a resin having a group which reacts with a cross-linking agent, such as hydroxyl group, amino group or carboxyl group, particularly preferably a hydroxyl group-containing polymer. To increase the strength of a layer which contains the polymer having an ultraviolet absorbing structure, use of the polymer having a hydroxyl value of 10 mgKOH/g or greater is preferable because adequate coating strength can be obtained, more preferably use of the polymer having a hydroxyl value of 30 mgKOH/g or greater, even more preferably use of the polymer having a hydroxyl value of 40 mgKOH/g or greater. By making the protective layer have adequate coating strength, it is possible to reduce degradation of the recording medium even when erasing and printing are repeatedly performed.

The thickness of the ultraviolet absorbing layer is preferably 0.1 μm to 30 μm, and more preferably 0.5 μm to 20 μm. To a solvent, a coating solution dispersing device, an applying method, a drying and cross-linking method and the like used for the ultraviolet absorbing layer coating solution, those known are used.

<Protective Layer>

The recording medium of the present invention may have a protective layer as the outermost surface of recording medium, for the purpose of protecting the recording medium or layers constituting the recording medium. The protective layer is suitably selected depending on the intended purpose without any restriction. For instance, the protective layer may be formed of one or more layers.

The protective layer contains a binder resin and further contains other components such as a filler, a lubricant, a coloring pigment and the like in accordance with the necessity.

The resin for the protective layer is suitably selected depending on the intended purpose without any restriction. For instance, the resin is preferably a thermosetting resin, an ultraviolet (UV) curable resin, an electron beam curable resin, etc., with particular preference being given to an ultraviolet (UV) curable resin and a thermosetting resin.

The UV-curable resin can form a very hard film after cross-linked so as to suppress damage caused by physical contact with the surface and deformation of the medium caused by laser heating; therefore, it is possible to obtain a recording medium superior in durability against repeated use.

Although slightly inferior to the UV-curable resin, the thermosetting resin can harden the surface in the same manner as the UV-curable resin, and is superior in durability against repeated use.

The UV-curable resin is suitably selected from known UV-curable resins depending on the intended purpose without any restriction. Examples thereof include oligomers based upon urethane acrylates, epoxy acrylates, polyester acrylates, polyether acrylates, vinyls and unsaturated polyesters; and monomers such as monofunctional and multifunctional acrylates, methacrylates, vinyl esters, ethylene derivatives and allyl compounds. Of these, multifunctional, i.e. tetrafunctional or higher, monomers and oligomers are particularly preferable. By mixing two or more of these monomers or oligomers, it is possible to suitably adjust the hardness, degree of contraction, flexibility, coating strength, etc. of the resin film.

To cross-link the monomers and the oligomers with an ultraviolet ray, it is necessary to use a photopolymerization initiator or a photopolymerization accelerator.

The amount of the photopolymerization initiator or the photopolymerization accelerator is preferably 0.1% by mass to 20% by mass, more preferably 1% by mass to 10% by mass, relative to the total mass of the resin component of the protective layer.

Ultraviolet irradiation for cross-linking the ultraviolet curable resin can be conducted using a known ultraviolet irradiator, and examples of the ultraviolet irradiator include one equipped with a light source, a lamp fitting, a power source, a cooling device, a conveyance device, etc.

Examples of the light source include a mercury-vapor lamp, a metal halide lamp, a potassium lamp, a mercury-xenon lamp and a flash lamp. The wavelength of the light source may be suitably selected according to the ultraviolet absorption wavelength of the photopolymerization initiator and the photopolymerization accelerator added to a composition for the recording medium.

The conditions of the ultraviolet irradiation are suitably selected depending on the intended purpose without any restriction. For instance, the lamp output, the conveyance speed, etc. may be decided according to the irradiation energy necessary to cross-link the resin.

The particle diameter of the inorganic pigment is preferably 0.01 μm to 10.0 μm, more preferably 0.05 μm to 8.0 μm. The amount of the inorganic pigment is preferably 0.001 parts by mass to 2 parts by mass, more preferably 0.005 parts by mass to 1 part by mass, relative to 1 part by mass of the heat resistant resin.

Further, known additives, such as a surfactant, a leveling agent, an antistatic agent, a releasing agent, a lubricant and the like may be contained in the protective layer.

Also, as the thermosetting resin, a resin similar to the binder resin used for the thermoreversible recording layer can be suitably used.

A polymer having an ultraviolet absorbing structure (hereinafter otherwise referred to as "ultraviolet absorbing polymer") may also be used.

It is desirable that the resin in the protective layer be cross-linked. The resin is preferably a resin having a group which reacts with a cross-linking agent, such as hydroxyl group, amino group or carboxyl group, with particular preference being given to a hydroxyl group-containing polymer.

As the cross-linking agent, the cross-linking agent similar to those used for the thermoreversible recording layer can be suitably used.

To a solvent, a coating solution dispersing device, an applying method, a drying method and the like used for the protective layer coating solution, those known can be used. When the ultraviolet curable resin is used, a cross-linking step by means of the ultraviolet irradiation with which coating and drying have been performed is necessary, in which case an ultraviolet irradiator, a light source and the irradiation conditions are as described above.

The thickness of the protective layer is 0.1 μm to 100 μm, and more preferably 0.5 μm to 50 μm.

<Under Layer>

In the present invention, an under layer may be provided between the thermoreversible recording layer and the support or between the oxygen blocking layer and the support, for the purpose of effectively utilizing applied heat for high sensitivity, or improving adhesiveness between the support and the oxygen blocking layer or the thermoreversible recording layer, and preventing permeation of recording layer materials into the support.

The under layer contains at least hollow particles, also contains a binder resin and further contains other components in accordance with the necessity.

Examples of the hollow particles include single hollow particles in which only one hollow portion is present in each particle, and multi hollow particles in which numerous hollow portions are present in each particle. These types of hollow particles may be used alone or in combination.

The material for the hollow particles is suitably selected depending on the intended purpose without any restriction, and suitable examples thereof include thermoplastic resins. For the hollow particles, suitably produced hollow particles may be used, or a commercially available product may be used. Examples of the commercially available product include MICROSPHERE R-300 (manufactured by Matsumoto Yushi-Seiyaku Co., Ltd.); ROPAQUE HP1055 and ROPAQUE HP433J (both of which are manufactured by Zeon Corporation); and SX866 (manufactured by JSR Corporation).

The amount of the hollow particles added to the under layer is suitably selected depending on the intended purpose without any restriction, and it is preferably 10% by mass to 80% by mass, for instance.

As the binder resin, known resins such as the resin similar to those used for the thermoreversible recording layer can be used.

The under layer may contain at least one of an organic filler and an inorganic filler such as calcium carbonate, magnesium carbonate, titanium oxide, silicon oxide, aluminum hydroxide, kaolin or talc.

Besides, the under layer may contain a lubricant, a surfactant, a dispersant and so forth.

The thickness of the under layer is suitably selected depending on the intended purpose without any restriction, with the range of 0.1 μm to 50 μm being preferable, the range of 2 μm to 40 μm being more preferable, and the range of 12 μm to 30 μm being even more preferable.

<Back Layer>

In the present invention, for the purpose of preventing curl and static charge on the recording medium and improving the conveyance capability, a back layer may be provided on a surface of the support opposite to a surface where the thermoreversible recording layer is formed.

The back layer contains at least a binder resin and further contains other components such as a filler, a conductive filler, a lubricant, a coloring pigment and the like in accordance with the necessity.

The binder resin is suitably selected depending on the intended purpose without any restriction. For instance, the binder resin is any one of a thermosetting resin, an ultraviolet (UV) curable resin, an electron beam curable resin, etc., with particular preference being given to an ultraviolet (UV) curable resin and a thermosetting resin.

As the ultraviolet curable resin, the thermosetting resin, the filler, the conductive filler and the lubricant, ones similar to those used for the thermoreversible recording layer, the protective layer or the ultraviolet absorbing layer can be suitably used.

<Adhesive Layer or Tackiness Layer>

In the present invention, the recording medium can be produced as a thermoreversible recording label by providing an adhesive layer or a tackiness layer on a surface of the support opposite to a surface where the thermoreversible recording layer is formed. The material for the adhesive layer or the tackiness layer can be selected from commonly used materials.

The material for the adhesive layer or the tackiness layer is suitably selected depending on the intended purpose without any restriction. Examples thereof include urea resins, melamine resins, phenol resins, epoxy resins, vinyl acetate resins, vinyl acetate-acrylic copolymers, ethylene-vinyl acetate copolymers, acrylic resins, polyvinyl ether resins, vinyl chloride-vinyl acetate copolymers, polystyrene resins, polyester resins, polyurethane resins, polyamide resins, chlorinated polyolefin resins, polyvinyl butyral resins, acrylic acid ester copolymers, methacrylic acid ester copolymers, natural rubbers, cyanoacrylate resins and silicone resins.

The material for the adhesive layer or the tackiness layer may be of a hot-melt type. Release paper may or may not be used. By thusly providing the adhesive layer or the tackiness layer, the thermoreversible recording label can be affixed to a whole surface or a part of a thick substrate such as a magnetic stripe-attached vinyl chloride card, which is difficult to coat with the thermoreversible recording layer. This makes it possible to improve the convenience of this medium, for example to display a part of information stored in a magnetic recorder. The thermoreversible recording label provided with the adhesive layer or the tackiness layer can also be used on thick cards such as IC cards and optical cards.

In the recording medium, a coloring layer may be provided between the support and the thermoreversible recording layer, for the purpose of improving visibility. The coloring layer can be formed by applying a dispersion solution or a solution containing a colorant and a resin binder over a surface to form the coloring layer and drying the dispersion solution or the solution; alternatively, the coloring layer can be formed by simply bonding a coloring sheet to the surface.

The recording medium may be provided with a color printing layer. A colorant in the color printing layer is, for example, selected from dyes, pigments and the like contained in color inks used for conventional full-color printing. Examples of the resin binder include thermoplastic resins, thermosetting resins, ultraviolet curable resins and electron beam curable resins. The thickness of the color printing layer may be suitably selected according to the desired printed color density, since the thickness is suitably changed depending on the desired printed color density.

In the recording medium, an irreversible recording layer may be additionally used. In this case, the colored color tones of the thermoreversible recording layers may be the same or different. Also, a coloring layer which has been printed in accordance with offset printing, gravure printing, etc. or which has been printed with any pictorial design or the like using an ink-jet printer, a thermal transfer printer, a sublimation printer, etc., for example, may be provided on the whole or a part of the same surface of the recording medium of the present invention as the surface where the thermoreversible recording layer is formed, or may be provided on a part of the opposite surface thereof. Further, an OP varnish layer composed mainly of a curable resin may be provided on a part or the whole surface of the coloring layer. Examples of the pictorial design include letters/characters, patterns, diagrams, photographs, and information detected with an infrared ray. Also, any of the layers may be colored simply by addition of a dye or a pigment.

Further, the recording medium of the present invention may be provided with a hologram for security. Also, to give variety in design, it may also be provided with a design such as a portrait, a company emblem or a symbol by forming depressions and protrusions in relief or in intaglio.

The recording medium may be formed into a desired shape according to its use, for example into a card, a tag, a label, a sheet or a roll. The recording medium in the form of a card can be used for prepaid cards, discount cards, i.e. so-called point cards, credit cards and the like. The recording medium in the form of a tag that is smaller in size than the card can be used for price tags and the like. The recording medium in the form of a tag that is larger in size than the card can be used for tickets, sheets of instruction for process control and shipping, and the like. The recording medium in the form of a label can be affixed; accordingly, it can be formed into a variety of sizes and, for example, used for process control and product control, being affixed to carts, receptacles, boxes, containers, etc. to be repeatedly used. The recording medium in the form of a sheet that is larger in size than the card offers a larger area for image recording, and thus it can be used for general documents and sheets of instruction for process control, for example.

<Image Recording and Image Erasing Mechanism>

The image recording and image erasing mechanism includes an aspect in which color tone reversibly changes by heat. The aspect is such that a leuco dye and a reversible developer (hereinafter otherwise referred to as "developer") are contained in the resin in the thermoreversible recording layer so as to reversibly change the color tone by heat between a transparent state and a colored state.

Figure 7A:
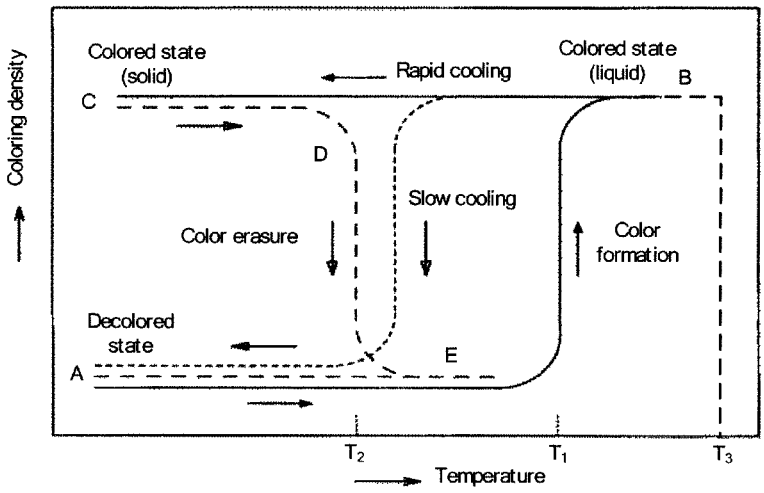
FIG. 7A is a graph showing the coloring and decoloring properties of a recording medium.
Figure 7B:
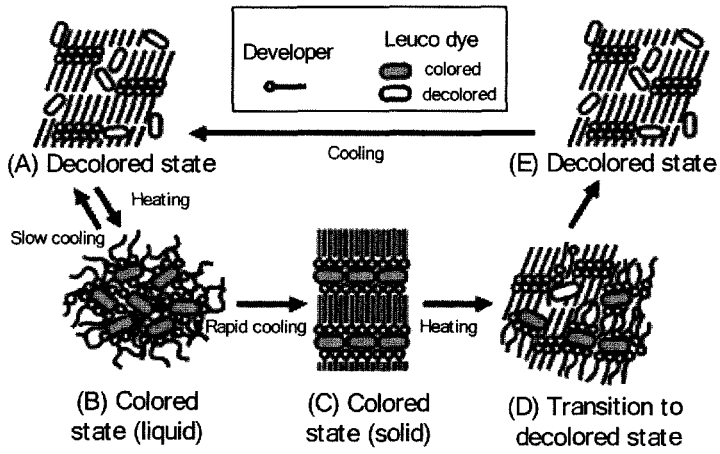
FIG. 7B is a schematic explanatory diagram showing a coloring and decoloring mechanism of a recording medium.

FIG. 7A shows an example of the temperature-coloring density change curve of a recording medium which has a thermoreversible recording layer formed of the resin containing the leuco dye and the developer. FIG. 7B shows the coloring and decoloring mechanism of the recording medium which reversibly changes by heat between a transparent state and a colored state.

First of all, when the thermoreversible recording layer in a decolored (colorless) state (A) is raised in temperature, the leuco dye and the developer melt and mix at the melting temperature $T_1$, thereby developing color, and the thermoreversible recording layer thusly comes into a melted and colored state (B). When the thermoreversible recording layer in the melted and colored state (B) is rapidly cooled, the thermoreversible recording layer can be lowered in temperature to room temperature, with its colored state kept, and it thusly comes into a colored state (C) where its colored state is stabilized and fixed. Whether or not this colored state is obtained depends upon the temperature decreasing rate from the temperature in the melted state: in the case of slow cooling, the color is erased in the temperature decreasing process, and the thermoreversible recording layer returns to the decolored state (A) it was in at the beginning, or comes into a state where the density is low in comparison with the density in the colored state (C) produced by rapid cooling. When the thermoreversible recording layer in the colored state (C) is raised in temperature again, the color is erased at the temperature $T_2$ lower than the coloring temperature (from D to E), and when the thermoreversible recording layer in this state is lowered in temperature, it returns to the decolored state (A) it was in at the beginning.

The colored state (C) obtained by rapidly cooling the thermoreversible recording layer in the melted state is a state where the leuco dye and the developer are mixed together such that their molecules can undergo contact reaction, which is often a solid state. This state is a state where a melted mixture (coloring mixture) of the leuco dye and the developer crystallizes, and thus color is maintained, and it is inferred that the color is stabilized by the formation of this structure. Meanwhile, the decolored state (A) is a state where the leuco dye and the developer are phase-separated. It is inferred that this state is a state where molecules of at least one of the compounds gather to constitute a domain or crystallize, and thus a stabilized state where the leuco dye and the developer are separated from each other by the occurrence of the flocculation or the crystallization. In many cases, phase separation of the leuco dye and the developer is brought about, and the developer crystallizes in this manner, thereby enabling color erasure with greater completeness.

As to both the color erasure by slow cooling from the melted state and the color erasure by temperature increase from the colored state shown in FIG. 7A, the aggregation structure changes at $T_2$, causing phase separation and crystallization of the developer.

Further, in FIG. 7A, when the temperature of the thermoreversible recording layer is repeatedly raised to the temperature $T_3$ higher than or equal to the melting temperature $T_1$, there may be caused such an erasure failure that an image cannot be erased even if the thermoreversible recording layer is heated to an erasing temperature. It is inferred that this is because the developer thermally decomposes and thus hardly flocculates or crystallizes, which makes it difficult for the developer to separate from the leuco dye. Degradation of the recording medium caused by repetitive image processing can be reduced by decreasing the difference between the melting temperature $T_1$ and the temperature $T_3$ in FIG. 7A when the recording medium is heated.

(Image Processing Method)

An image processing method of the present invention includes at least any one of an image recording step and an image erasing step, and further includes other steps suitably selected in accordance with the necessity.

The image processing method of the present invention includes an aspect of performing image recording and erasing, an aspect of performing only image recording, and an aspect of performing only image erasing.

<Image Recording Step and Image Erasing Step>

The image recording step in the image processing method of the present invention is a step of heating the recording medium so as to record an image. A method for heating the recording medium is exemplified by known heating methods, for example, the method using a thermal head, laser light irradiation, or the like. Suppose that the recording medium is used in physical distribution lines, a method of heating the recording medium by applying a laser light is particularly preferable, because an image can be formed in a non-contact manner.

The thermosensitive recording medium is preferably a thermoreversible recording medium on which image recording and erasing can be repeatedly performed.

The image erasing step in the image processing method of the present invention is a step of heating the recording medium so as to erase an image recorded in the recording medium. As a heat source, a laser light or other heat sources may be used. In the case where heating is performed by irradiating with a laser light, it takes a time to irradiate an entire section of a predetermined area by scanning with a single ray of the laser light. When the image erasing is performed for a short time, the image erasing is preferably performed by heating using a thermal head, an infrared lamp, a heat roller, a hot stamp, a dryer, or the like. In the case where recording medium is attached to a styrene foam box as a shipping container used in physical distribution lines, the styrene foam box is melted by heating. Thus it is preferred that only the recording medium be locally heated by the laser light irradiation so as to erase an image.

The thermosensitive recording medium is preferably a thermoreversible recording medium, on which image recording and erasing can be repeatedly performed.

The recording medium is heated by the laser light irradiation, so that an image can be recorded on the recording medium in a non-contact manner.

In the image processing method of the present invention, at the time of reusing the recording medium, the image is erased for the first time (the image erasing step), and then an image is recorded in the image recording step. However, the order of the image recording and erasing is not limited thereto, and alternatively an image may be recorded in the image recording step, and then the image may be erased in the image erasing step.

The laser light may be suitably selected depending on the intended purpose without any restriction. Examples thereof include to lights emitted from generally used lasers such as a YAG laser, a fiber laser, and a semiconductor laser (LD). Of these, in the case where the recording medium is used in physical distribution lines, the semiconductor laser light is particularly preferably used, in terms that a laser light source itself is small, thereby achieving downsizing of the device and price-reduction as a laser device.

The output of the laser light applied in the image recording step is suitably selected depending on the intended purpose without any restriction; however, it is preferably 1 W or greater, more preferably 3 W or greater, and even more preferably 5 W or greater. When the output of the laser light is less than 1 W, it takes a long time to record an image, and if an attempt is made to reduce the time spent on image recording, a high-density image cannot be obtained because of the insufficient output. Additionally, the upper limit of the output of the laser light is suitably selected depending on the intended purpose without any restriction; it is preferably 200 W or less, more preferably 150 W or less, and even more preferably 100 W or less. When the output of the laser light is greater than 200 W, a laser device may be increased in size.

The scanning velocity of the laser light applied in the image recording step is suitably selected depending on the intended purpose without any restriction; it is preferably 300 mm/s or greater, more preferably 500 mm/s or greater, and even more preferably 700 mm/s or greater. When the scanning velocity is less than 300 mm/s, it takes a long time to record an image. Additionally, the upper limit of the scanning velocity of the laser light is suitably selected depending on the intended purpose without any restriction; it is preferably 15,000 mm/s or less, more preferably 10,000 mm/s or less, and even more preferably 8,000 mm/s or less. When the scanning velocity is higher than 15,000 mm/s, it is difficult to record a uniform image.

The spot diameter of the laser light applied in the image recording step is suitably selected depending on the intended purpose without any restriction; it is preferably 0.02 mm or greater, more preferably 0.1 mm or greater, and even more preferably 0.15 mm or greater. Additionally, the upper limit of the spot diameter of the laser light is suitably selected depending on the intended purpose without any restriction; it is preferably 3.0 mm or less, more preferably 2.5 mm or less, and even more preferably 2.0 mm or less. When the spot diameter is small, the line width of an image is also thin, and the contrast of the image lowers, causing a decrease in visibility. When the spot diameter is large, the line width of an image is also thick, and adjacent lines overlap, making it impossible to record small letters/characters.

The output of the laser light for irradiation in the image erasing step, that is irradiating the recording medium with the laser light so as to heat, thereby erasing an image, may be suitably selected depending on the intended purpose without any restriction. It is preferably 5 W or greater, more preferably 7 W or greater, and even more preferably 10 W or greater. When the output of the laser light is less than 5 W, it takes a long time to erase an image, and if an attempt is made to reduce the time spent on image erasure, image erasing failure occurs because of the insufficient output.

Additionally, the upper limit of the output of the laser light is suitably selected depending on the intended purpose without any restriction; it is preferably 200 W or less, more preferably 150 W or less, and even more preferably 100 W or less. When the output of the laser light is greater than 200 W, a laser device may be increased in size.

The scanning velocity of the laser light for irradiation in the image erasing step, that is irradiating the recording medium with the laser light so as to heat, thereby erasing an image, is suitably selected depending on the intended purpose without any restriction; it is preferably 100 mm/s or greater, more preferably 200 mm/s or greater, and even more preferably 300 mm/s or greater. When the scanning velocity is less than 100 mm/s, it takes a long time to erase an image.

Additionally, the upper limit of the scanning velocity of the laser light is suitably selected depending on the intended purpose without any restriction; it is preferably 20,000 mm/s or less, more preferably 15,000 mm/s or less, and even more preferably 10,000 mm/s or less. When the scanning velocity is higher than 20,000 mm/s, it is difficult to erase a uniform image.

The spot diameter of the laser light for irradiation in the image erasing step, that is irradiating the recording medium with the laser light so as to heat, thereby erasing an image, is suitably selected depending on the intended purpose without any restriction; it is preferably 0.5 mm or greater, more preferably 1.0 mm or greater, and even more preferably 2.0 mm or greater.

Additionally, the upper limit of the spot diameter of the laser light is suitably selected depending on the intended purpose without any restriction; it is preferably 14.0 mm or less, more preferably 10.0 mm or less, and even more preferably 7.0 mm or less.

When the spot diameter of the laser light is smaller than the lower limit thereof, it takes a long time to erase an image. When the spot diameter of the laser light is larger than the upper limit thereof, image erasing failure occurs because of the insufficient output.

<Image Processing Device>

An image processing device used in the present invention includes at least an image processing unit, and further includes other units suitably selected in accordance with the necessity.

-Image Processing Unit-

As the image processing unit used in the image recording step and/or the image erasing step, a thermal head, a laser light emitting unit or the like may be used. Of these, a laser light emitting unit is particularly preferably used.

The laser light emitting unit is suitably selected depending on the intended purpose without any restriction, as long as the laser light has the maximum wavelength near the maximum absorption peak of the photothermal conversion material contained in the recording medium. Examples thereof include a YAG laser, a fiber laser, and a semiconductor laser (LD), but not limited thereto.

Here, the wavelength of the laser light is particularly preferably a single wavelength.

The wavelength of the laser light emitted from the YAG laser, fiber laser, or semiconductor laser (LD) is in the visible to near infrared region (several hundred micrometers to 1.2 μm). The use of such lasers has an advantage such that a highly precise image can be recorded because the wavelength of the laser light is short. In addition, as the YAG laser and fiber laser have high output, there is an advantage such that image processing can be high speeded. The semiconductor laser has an advantage such that the device can be downsized and reduced in price, as the laser itself is small. Suppose that the recording medium is used in physical distribution lines, a laser light emitted from the semiconductor laser is particularly preferable.

A wavelength of the laser light emitted from the laser light emitting unit is suitably selected depending on the intended purpose without any restriction; it is preferably 600 nm to 1,200 nm, and more preferably 700 nm to 1,100 nm, because various resins contained in the recording medium are less absorbed. When the wavelength is less then 600 nm, the recording medium is easily degraded by the laser light irradiation. When the wavelength is more than 1,200 nm, the laser light is absorbed in the various resins contained in the recording medium, and it is necessary to use a high output semiconductor laser, causing an increase of a laser device in size.

The image processing device of the present invention has the same basic structure as that of the one which is generally referred to as a laser marker, except that the image processing device includes at least the laser light emitting unit. The image processing device includes at least an oscillator unit, a power supply controlling unit, and a program unit.

Here, with reverence to FIG. 8, an example of an image processing device used in the present invention, mainly the laser light emitting unit, will be described. The image processing device shown in FIG. 8 uses a fiber coupled semiconductor laser, LIMO25F100-DL808-EX362 (manufactured by LIMO) as a laser light source, in which the maximum output is 25 W under the conditions of an emission wavelength of 808 nm and a fiber diameter of 100 μm. Immediately after a laser light is emitted from the fiber, the light is collimated to a parallel light using a collimator. In a parallel light path, a mask or an aspherical lens may be combined as a light irradiation intensity distribution adjusting unit so as to adjust the changes of light intensity distribution in a cross section orthogonal to the travelling direction of the laser light.

The oscillator unit contains a laser oscillator 1, a beam expander 2, a scanning unit 5, and the like.

The scanning unit 5 includes a galvanometer (not shown), and a galvanometer mirror 4A mounted to the galvanometer (not shown). The laser light output from the laser oscillator 1 is rotary scanned at high speed by two galvanometer mirrors 4A each mounted to the galvanometer (not shown) and disposed in the directions of X axis and Y axis, respectively, to thereby record or erase an image on a recording medium 7.

The power supply controlling unit includes a driving power supply of a light source configured to excite a laser medium, a driving power supply for the galvanometer, a power supply for cooling such as Peltier element, and a control unit for controlling the entire image processing device.

The program unit is a unit configured to input conditions such as an intensity, scanning velocity and the light of laser light, form and edit characters to be recorded or the like for image recording or image erasing based on input from a touch-panel or keyboard.

The laser light emitting unit, namely a head part for image recording and erasing, is mounted to the image processing device, and the image processing device further includes a conveying unit for the recording medium, a controlling unit thereof, a monitor unit (a touch-panel) and the like.

The image processing method of the present invention is capable of repeatedly recording and erasing an image on a recording medium, such as a label attached to a container such as a cardboard box or a plastic container, at high speed in a non-contact system. In addition, the image processing method uses the recording medium having sufficient decoloring property, in which no decrease in image density and no background coloring occur even though it is exposed to light for a long time. For this reason, the image processing method is especially suitably used for physical distribution and delivery systems. In this case, an image can be recorded on and erased from the label while transferring the cardboard box or plastic container placed on the conveyer belt, and thus the time required for shipping can be reduced as it is not necessary to stop the production line. The cardboard box or the plastic container, to which the label is attached can be reused without releasing the label, and image erasing and recording can be performed again.

EXAMPLES

Hereinafter, Examples of the present invention will be explained. However, it should be noted that the present invention is not confined to these Examples in any way.

In each of Examples and Comparative Examples, as a preferred example of the thermosensitive recording medium, a thermoreversible recording medium was produced and evaluated. However, the case where image recording and erasing were not repeatedly performed, but image recording was performed only once on the thermoreversible recording medium, corresponded to Example in which the thermosensitive recording medium was evaluated.

The oxygen permeability in each of Examples and Comparative Examples was measured at 25° C. and 80% RH by an oxygen permeation measuring device (OX-TRAN100, manufactured by MOCON Inc.).

Example 1

<Production of Thermoreversible Recording Medium>

-Support-

As a support, a white turbid polyester film (TETORON FILM U2L98W, manufactured by Teijin DuPont Films Japan Limited) having a thickness of 125 μm was used.

-Thermoreversible Recording Layer-

Using a ball mill, 5 parts by mass of a reversible developer represented by Structural Formula (1) below, 0.5 parts by mass each of the two types of color erasure accelerators represented by Structural Formulae (2) and (3) below, 10 parts by mass of a 50 mass % acrylpolyol solution (hydroxyl value=200 mgKOH/g), and 80 parts by mass of methyl ethyl ketone were pulverized and dispersed such that the average particle diameter became approximately 1 μm.

Structural Formula (1)

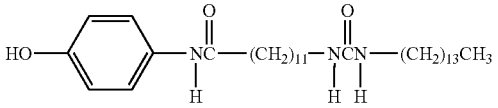

(Reversible Developer)
(Color Erasure Accelerator)

-continued

Structural Formula (2)

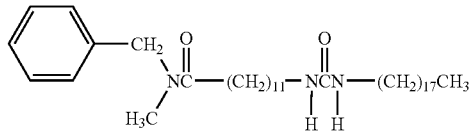

Structural Formula (3)

$C_{17}H_{35}CONHC_{18}H_{37}$

Next, into the dispersion solution in which the reversible developer had been pulverized and dispersed, 1 part by mass of 2-anilino-3-methyl-6-dietylaminofluoran as a leuco dye, 0.025 parts by mass of a phthalocyanine photothermal conversion material (IR-14, manufactured by NIPPON SHOKUBAI CO., LTD.), and 5 parts by mass of an isocyanate compound (CORONATE HL, manufactured by Nippon Polyurethane Industry Co., Ltd.) were added, and then sufficiently stirred, so as to prepare a thermoreversible recording layer coating solution.

Then, the prepared thermoreversible recording layer coating solution was applied, using a wire bar, to the support, and heated at 100° C. for 2 min, dried, and then cured at 60° C. for 24 hr so as to form a thermoreversible recording layer having a thickness of 10 μm.

-Ultraviolet Absorbing Layer-

A 40 mass % ultraviolet absorbing polymer solution (UV-G302, manufactured by NIPPON SHOKUBAI CO., LTD.) (10 parts by mass), 1.0 part by mass of an isocyanate compound (CORONATE HL, manufactured by Nippon Polyurethane Industry Co., Ltd.) and 12 parts by mass of methyl ethyl ketone were added and sufficiently stirred so as to prepare an ultraviolet absorbing layer coating solution.

Next, the prepared ultraviolet absorbing layer coating solution was applied, using a wire bar, to the support on which the thermoreversible recording layer had already been formed, and heated at 90° C. for 1 min, and then dried, and further heated at 60° C. for 24 hr so as to form an ultraviolet absorbing layer having a thickness of 10 μm.

-First Oxygen Blocking Layer-

To a silica deposited PET film (TECHBARRIER HX, manufactured by Mitsubishi Plastics, Inc., an oxygen permeability of 0.05 mL/($m^2$·24 hr·atm) at 25° C. and 80% RH) having a thickness of 12 μm, an adhesive layer coating solution consisting of 5 parts by mass of an urethane adhesive (TM-567, manufactured by Toyo-Morton, Ltd.), 0.5 parts by mass of an isocyanate compound (CAT-RT-37, manufactured by Toyo-Morton, Ltd.) and 5 parts by mass of ethyl acetate was applied, using a wire bar, and heated at 80° C. for 1 min and dried. Next, silica is deposited PET film was adhered onto the support, over which the thermoreversible recording layer and the ultraviolet absorbing layer were formed, and then heated at 50° C. for 24 hr so as to form a first oxygen blocking layer.

-Back Layer-

Pentaerythritol hexaacrylate (KAYARAD DPHA, manufactured by

Nippon Kayaku Co., Ltd.) (parts by mass), parts by mass of an urethane acrylate oligomer (ART RESIN UN-3320HA, manufactured by Negami Chemical Industrial Co., Ltd.), 2.5 parts by mass of a needle-like conductive titanium oxide (FT-3000, major axis=5.15 μm, minor axis=0.27 μm, structure: titanium oxide coated with antimony-doped tin oxide; manufactured by Ishihara Sangyo Kaisha, Ltd.), 0.5 parts by mass of a photopolymerization initiator (IRGACURE 184, manufactured by Nihon Ciba-Geigy K.K.) and 13 parts by mass of isopropyl alcohol were mixed, and sufficiently stirred using a ball mill, so as to prepare a back layer coating solution.

Next, the back layer coating solution was applied, using a wire bar, to a surface of the support opposite to a surface thereof over which the thermoreversible recording layer had already been formed, and heated at 90° C. for 1 min, dried, and then cross-linked by means of an ultraviolet lamp of 80 W/cm, so as to form a back layer having a thickness of 4 μm. Thus, a thermoreversible recording medium of Example 1 was produced.

Example 2

<Production of Thermoreversible Recording Medium>

A second thermoreversible recording layer was formed in the same manner as in Example 1, except that the thermoreversible recording layer of Example 1 which was modified so as not to contain the phthalocyanine photothermal conversion material and so as to have a thickness of 4 μm, was formed over the support of Example 1.

Then, the photothermal conversion layer coating solution described below was applied, using a wire bar, to the support over which the second thermoreversible recording layer had already been formed, and heated at 90° C. for 1 min, dried, and then cured at 60° C. for 2 hr so as to form a photothermal conversion layer having a thickness of 2 μm.

-Preparation of Photothermal Conversion Layer Coating Solution-

A 50 mass % acrylpolyol resin solution (LR327, manufactured by Mitsubishi Rayon Co., Ltd.) (6 parts by mass), 0.038 parts by mass of a phthalocyanine photothermal conversion material (IR-14 manufactured by NIPPON SHOKUBAI CO., LTD.), 2.4 parts by mass of an isocyanate compound (CORONATE HL, manufactured by Nippon Polyurethane Industry Co., Ltd.), and 14 parts by mass of methyl ethyl ketone were mixed, and sufficiently stirred to prepare a photothermal conversion layer coating solution.

Next, a first thermoreversible recording layer was formed in the same manner as in Example 1, except that the thermoreversible recording layer of Example 1 which was modified so as not to contain the phthalocyanine photothermal conversion material and so as to have a thickness of 6 μm, was formed over the photothermal conversion layer of Example 1.

Then, over the first thermoreversible recording layer, the ultraviolet absorbing layer, the first oxygen blocking layer and the back layer were formed in the same manner as in Example 1. Thus, a thermoreversible recording medium of Example 2 was produced.

Example 3

-Production of Thermoreversible Recording Medium-

A thermoreversible recording medium was produced in the same manner as in Example 1, except that a second oxygen blocking layer produced in the same manner as the first oxygen blocking layer of Example 1 was formed between the support and the thermoreversible recording layer.

Example 4

-Production of Thermoreversible Recording Medium-

A thermoreversible recording medium was produced in the same manner as in Example 2, except that a second oxygen blocking layer produced in the same manner as the first oxygen blocking layer of Example 2 was formed between the support and the second thermoreversible recording layer.

Example 5

-Production of Thermoreversible Recording Medium-

A thermoreversible recording medium was produced in the same manner as in Example 4, except that the first and second oxygen blocking layers of Example 4 were replaced with alumina deposited PET films (BARRIALOX VM-1011 SG-CX, manufactured by TORAY ADVANCED FILM Co., Ltd., an oxygen permeability of 0.3 mL/($m^2$·24 hr·atm) at 25° C. and 80% RH) each having a thickness of 12 μm.

Example 6

-Production of Thermoreversible Recording Medium-

A thermoreversible recording medium was produced in the same manner as in Example 4, except that the first and second oxygen blocking layers of Example 4 were replaced with silica deposited PET films (TECHBARRIER L, manufactured by Mitsubishi Plastics, Inc., an oxygen permeability of 0.5 mL/($m^2$·24 hr·atm) at 25° C. and 80% RH) each having a thickness of 12 μm.

Example 7

-Production of Thermoreversible Recording Medium-

A thermoreversible recording medium was produced in the same manner as in Example 4, except that the first and second oxygen blocking layers of Example 4 were each replaced with a laminate of three silica deposited PET films (TECHBARRIER HX, manufactured by Mitsubishi Plastics, Inc., an oxygen permeability of 0.05 mL/($m^2$·24 hr·atm) at 25° C. and 80% RH). Here, the laminate was formed by bonding three silica deposited PET films each having a thickness of 12 μm with an adhesive layer intervening between the silica deposited PET films, and each adhesive layer was formed of 5 parts by mass of an urethane adhesive (TM-567, manufactured by Toyo-Morton, Ltd.), 0.5 parts by mass of an isocyanate compound (CAT-RT-37, manufactured by Toyo-Morton, Ltd.) and 5 parts by mass of ethyl acetate.

Example 8

-Production of Thermoreversible Recording Medium-

A thermoreversible recording medium was produced in the same manner as in Example 4, except that the first and second oxygen blocking layers of Example 4 were each replaced with a laminate of five silica deposited PET films (TECHBARRIER HX, manufactured by Mitsubishi Plastics, Inc., an oxygen permeability of 0.05 mL/($m^2$·24 hr·atm) at 25° C. and 80% RH). Here, the laminate was formed by bonding five silica deposited PET films each having a thickness of 12 μm with an adhesive layer intervening between the silica deposited PET films, and each adhesive layer was formed of 5 parts by mass of an urethane adhesive (TM-567, manufactured by Toyo-Morton, Ltd.), 0.5 parts by mass of an isocyanate compound (CAT-RT-37, manufactured by Toyo-Morton, Ltd.) and 5 parts by mass of ethyl acetate.

Example 9

-Production of Thermoreversible Recording Medium-

An intermediate layer coating solution described below was applied, using a wire bar, to the support, over which the second oxygen blocking layer and the second thermoreversible recording layer of Example 4 were formed, and heated at 90° C. for 1 min, dried, and then heated at 60° C. for 24 hr so as to form a second intermediate layer having a thickness of 1.5 μm.

-Preparation of Intermediate Layer Coating Solution-

A 50 mass % acrylpolyol resin solution (LR327, manufactured by Mitsubishi Rayon Co., Ltd.) (6 parts), 2.4 parts by mass of an isocyanate compound (CORONATE HL, manufactured by Nippon Polyurethane Industry Co., Ltd.), and 14 parts by mass of methyl ethyl ketone were mixed, and sufficiently stirred to prepare the intermediate layer coating solution.

Next, the photothermal conversion layer produced in the same manner as Example 4 was formed over the second intermediate layer in the same manner as in Example 4, and the intermediate layer coating solution was applied to the photothermal conversion layer so as to form a first intermediate layer produced in the same manner as the second intermediate layer.

Then, the first thermoreversible recording layer, the ultraviolet absorbing layer, the first oxygen blocking layer and the back layer were formed in the same manner as in Example 4, so as to produce a thermoreversible recording medium.

Comparative Example 1

-Production of Thermoreversible Recording Medium-

A thermoreversible recording medium was produced in the same manner as in Example 1, except that the first oxygen blocking layer was not formed on the ultraviolet absorbing layer.

Comparative Example 2

-Production of Thermoreversible Recording Medium-

A thermoreversible recording medium was produced in the same manner as in Example 2, except that the first oxygen blocking layer was not formed on the ultraviolet absorbing layer.

Comparative Example 3

-Production of Thermoreversible Recording Medium-

A thermoreversible recording medium was prepared in the same manner as in Example 1, except that the first oxygen blocking layer of Example 1 was replaced with an ethylene-vinyl alcohol copolymer film (ethylene content: 32 mol %, an oxygen permeability of 1.5 mL/($m^2$·24 hr·atm) at 25° C. and 80% RH) having a thickness of 15 μm.

Comparative Example 4

-Production of Thermoreversible Recording Medium-

A thermoreversible recording medium was prepared in the same manner as in Example 4, except that the first and second oxygen blocking layers of Example 4 were replaced with alumina deposited PET films (BARRIALOX VM-1011HG, manufactured by TORAY ADVANCED FILM Co., Ltd., an oxygen permeability of 1.5 mL/($m^2$·24 hr·atm) at 25° C. and 80% RH) each having a thickness of 12 μm.

Comparative Example 5

-Production of Thermoreversible Recording Medium-

A thermoreversible recording medium was produced in the same manner as in Example 4, except that the first and second oxygen blocking layers of Example 4 were replaced with transparent PET films (LUMIRROR 25-T60 manufactured by TORAY INDUSTRIES, INC., an oxygen permeability of 50 mL/($m^2$·24 hr·atm) at 25° C. and 80% RH) each having a thickness of 25 μm.

Comparative Example 6

-Production of Thermoreversible Recording Medium-

A thermoreversible recording medium was produced in the same manner as in Example 3, except that the thermoreversible recording layer of Example 3 was modified so as not to contain the isocyanate compound.

Comparative Example 7

-Production of Thermoreversible Recording Medium-

A thermoreversible recording medium was produced in the same manner as in Example 4, except that the photothermal conversion layer of Example 4 was modified so as not to contain the isocyanate compound.

<Evaluation of Laser Recording>

Figure 8:
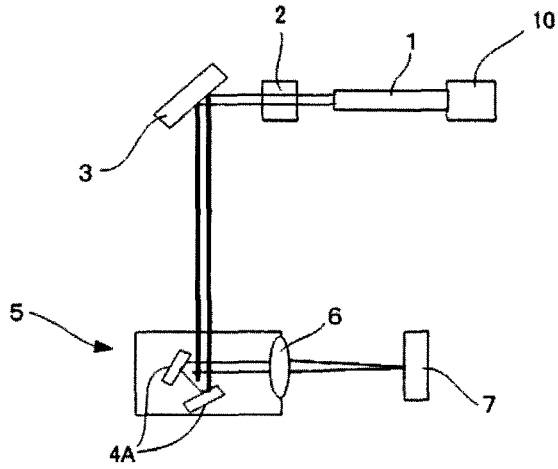
FIG. 8 is a diagram explaining one example of an image processing device used in an image processing method of the present invention.

As a semiconductor laser light source as shown in FIG. 8, using a semiconductor laser device equipped with a semiconductor laser LIMO25-F-DL808 (manufactured by LIMO; center wavelength: 808 nm), which was adjusted so that an irradiation distance and a linear velocity respectively became 152 mm and 1,000 mm/s., each of the thermoreversible recording media produced in Examples and Comparative Examples was linearly scanned with laser lights at 0.3 mm interval, so as to record a solid image on the thermoreversible recording medium. Upon recording, the output of the laser light was 13 W in Examples 1 to 6 and Comparative Examples 1 to 7, and 15 W in Examples 7 to 9.

The semiconductor laser device was adjusted so that an irradiation distance, a linear velocity and a spot diameter respectively became 200 mm, 500 mm/s, and 3.0 mm. Using the semiconductor laser device, the image was erased by linearly scanning the thermoreversible recording medium with laser lights at 0.5 mm interval. Upon erasure, the output of the laser light was 16 W in Examples 1 to 6 and Comparative Examples 1 to 7, and 18 W in Examples 7 to 9.

<Evaluation of Light Resistance 1>

At first, in the initial state, the absorbance at a wavelength of 808 nm of each of thermoreversible recording media of Examples 1 to 9 and Comparative Examples 1 to 7 was measured by a spectrophotometer (U-4100, manufactured by Hitachi High-Technologies Corporation). The results are shown in Table 1.

Subsequently, the thermoreversible recording medium was irradiated with a light at 30° C. and 80% RH, and 130 klx for 72 hr using an artificial sunlight irradiation device (manufactured by SERIC LTD.), and then the absorbance at a wavelength of 808 nm of the thermoreversible recording medium was measured by the spectrophotometer. The absorbance in the initial state and the absorbance after light irradiation were compared. The results are shown in Table 1.

<Amount of Decrease in Image Density after Light Irradiation>

An image was recorded on each of the thermoreversible recording media of Examples 1 to 9 and Comparative Examples 1 to 7 under the aforementioned laser recording conditions, and an initial image density was measured by X-Rite 938 manufactured by X-rite. Then, the thermoreversible recording medium on which an image had been recorded was irradiated with a light at 30° C. and 85% RH, and 130 klx for 72 hr using the artificial sunlight irradiation device (manufactured by SERIC LTD.). An image density of an image part was measured by X-Rite 938 manufactured by X-rite, and an amount of decrease in the image density after light irradiation was obtained by Equation 1. The results are shown in Table 1.

$$\text{Amount of decrease in image density} = \text{Initial image density} - \text{Image density after light irradiation} \quad \text{Equation 1}$$

<Residual Image Density after Light Irradiation>

Next, an image was recorded on each of the thermoreversible recording media of Examples 1 to 9 and Comparative Examples 1 to 7 under the aforementioned laser recording conditions, and was irradiated with a light at 30° C. and 80% RH, and 130 klx for 72 hr using the artificial sunlight irradiation device (manufactured by SERIC LTD.). Thereafter, an image part and a background part were heated at 1 kgf/cm$^2$ for 2 sec using a heat gradient tester (manufactured by Toyo Seiki Seisaku-sho, Ltd.), then an erasure density and a background density were measured by X-Rite 938 manufactured by X-rite. The residual image density was obtained by Equation 2. The results are shown in Table 1.

$$\text{Residual Image Density} = \text{Erasure Density} - \text{Background Density} \quad \text{Equation 2}$$

<Evaluation of Durability Against Repeated Use>

The image recording and erasing were performed 500 times on each of the thermoreversible recording media of Examples 1 to 9 and Comparative Examples 1 to 7 under the aforementioned laser recording conditions and laser erasing conditions, and then a surface of the thermoreversible recording medium was visually evaluated. "A" represents no undesirable appearance caused by air bubble. "B" represents undesirable appearance caused by air bubble. The results are shown in Table 1.

<Evaluation of Light Resistance 2>

The image recording and erasing were performed 100 times on each of the thermoreversible recording media of Examples 4 and 9 under the aforementioned laser recording conditions and laser erasing conditions, and then firstly in an erased state the absorbance at a wavelength of 808 nm of the thermoreversible recording medium was measured by the spectrophotometer (U-4100, manufactured by Hitachi High-Technologies Corporation). The results are shown in Table 2.

Next, the thermoreversible recording medium was irradiated with a light at 30° C. and 80% RH, and 130 klx for 72 hr using the artificial sunlight irradiation device (manufactured by SERIC LTD.), and then in the same manner as in the erased state, the absorbance at a wavelength of 808 nm of the thermoreversible recording medium was measured by the spectrophotometer. The results are shown in Table 2.

TABLE 1

| | Evaluation of Light Resistance 1 | | Amount of decrease in image | Residual image | Durability |
|---|---|---|---|---|---|
| | Initial absorbance | Absorbance after light irradiation | density after light irradiation | density after light irradiation | against repeated use |
| Example 1 | 0.43 | 0.33 | 0.168 | 0.033 | A |
| Example 2 | 0.43 | 0.38 | 0.150 | 0.033 | A |
| Example 3 | 0.42 | 0.34 | 0.035 | 0.015 | A |
| Example 4 | 0.42 | 0.41 | 0.007 | 0.014 | A |
| Example 5 | 0.42 | 0.40 | 0.084 | 0.020 | A |
| Example 6 | 0.42 | 0.39 | 0.105 | 0.024 | A |
| Example 7 | 0.43 | 0.43 | 0.003 | 0.010 | A |
| Example 8 | 0.42 | 0.42 | 0.001 | 0.006 | A |
| Example 9 | 0.42 | 0.42 | 0.002 | 0.014 | A |
| Comparative Example 1 | 0.42 | 0.22 | 0.532 | 0.150 | A |

TABLE 1-continued

| | Evaluation of Light Resistance 1 | | Amount of decrease in image | Residual image | Durability |
|---|---|---|---|---|---|
| | Initial absorbance | Absorbance after light irradiation | density after light irradiation | density after light irradiation | against repeated use |
| Comparative Example 2 | 0.42 | 0.27 | 0.515 | 0.148 | A |
| Comparative Example 3 | 0.43 | 0.33 | 0.264 | 0.056 | A |
| Comparative Example 4 | 0.42 | 0.32 | 0.241 | 0.045 | A |
| Comparative Example 5 | 0.41 | 0.29 | 0.363 | 0.086 | A |
| Comparative Example 6 | 0.40 | 0.32 | 0.032 | 0.015 | B |
| Comparative Example 7 | 0.40 | 0.39 | 0.009 | 0.015 | B |

TABLE 2

| | Evaluation of Light Resistance 2 | |
|---|---|---|
| | Absorbance after 100 times | Absorbance after light irradiation |
| Example 4 | 0.40 | 0.30 |
| Example 9 | 0.41 | 0.40 |

As can be seen from the results of Table 1, in Examples 1 to 9, the oxygen blocking layers each having an oxygen permeability of 0.5 mL/(m$^2$·24 hr·atm) or less at 25° C. and 80% RH were formed over both surfaces of the thermoreversible recording layer and the resin contained in the layer containing the photothermal conversion material was in a cross-linked state. Thus, even after the evaluation of light resistance, the leuco dye was not degraded by light and had sufficient decoloring to property, and the surface of the thermoreversible recording medium was not changed in appearance even after image recording and erasing were repeatedly performed, and thus the thermoreversible recording medium had sufficient durability against repeated use.

Moreover, in Example 1 and Example 3, the photothermal conversion material was contained in the thermoreversible recording layer, and interacted with the leuco dye to decrease the absorption of the photothermal conversion material after the evaluation of light resistance. However, each of the thermoreversible recording media in Examples 2 and 4 to 8 was provided with the photothermal conversion layer so as to suppress the mixture of the photothermal conversion material and the leuco dye, and thus the absorption of the photothermal conversion material hardly changed even after the evaluation of light resistance.

On the other hand, in Comparative Examples 1 to 5, since oxygen was not sufficiently blocked, the thermoreversible recording medium did not sufficiently have decoloring property after the evaluation of light resistance, and the residual image occurred. In Comparative Examples 6 to 7, since oxygen was sufficiently blocked, the thermoreversible recording medium sufficiently had the decoloring property even after the evaluation of light resistance. However, since the resin contained in the layer containing the photothermal conversion material was not in a cross-linked state, air bubbles were formed by repeatedly performing image recording and erasing, and thus the surface of the thermoreversible recording medium was undesirable in appearance.

As can be seen from the results of Table 2, in Example 4, after the image recording and erasing were performed 100 times, the photothermal conversion material and the leuco dye were mixed, and thus the absorbance of the photothermal conversion material was decreased after the evaluation of light resistance. On the other hand, in Example 9 the intermediate layer was formed in the thermoreversible recording medium, so as to suppress the mixture of the photothermal conversion material and the leuco dye due to repeatedly heating. The absorbance of the photothermal conversion material was hardly changed, even after the evaluation of light resistance after the image recording and erasing were performed 100 times.

The thermosensitive recording medium of the present invention has sufficient decoloring property even though it is exposed to light for a long time, and the surface of the thermosensitive recording medium is not damaged in appearance even though image recording and erasing are repeatedly performed. Thus, the thermosensitive recording medium can be attached to a container such as a cardboard box or a plastic container, in which a high contrast image can be repeatedly recorded and erased at high speed in a non-contact manner, and even when the thermosensitive recording medium is exposed to light for a long time the light degradation of the leuco dye and the photothermal conversion material can be suppressed, thereby capable of suitably using the thermosensitive recording medium for physical distribution and delivery systems.

What is claimed is:

1. A thermosensitive recording medium comprising:

a support;

a photothermal conversion layer containing a photothermal conversion material, formed over the support; and an oxygen blocking layer formed over the photothermal conversion layer, wherein the photothermal conversion layer further contains a resin, which is in a cross-linked state, and the photothermal conversion material absorbs a light having a specific wavelength and converts the light into heat, wherein the oxygen blocking layer has an oxygen permeability of 0.5 mL/($m^2$·24 hr·atm) or less at 25° C. and 80% RH, and wherein (a) the photothermal conversion layer is also a thermoreversible recording layer or (b) the photothermal conversion is not also a thermoreversible recording layer and the thermosensitive recording medium further comprises a thermoreversible recording layer.

2. The thermosensitive recording medium according to claim 1, wherein the photothermal conversion layer is a thermoreversible recording layer, and the thermoreversible recording layer contains a leuco dye and a reversible developer, in which color tone reversibly changes by heat.

3. The thermosensitive recording medium according to claim 2, further comprising other oxygen blocking layer which is formed any one of between the support and the thermoreversible recording layer, and on a surface of the support opposite to a surface thereof on which the thermoreversible recording layer s formed.

4. The thermosensitive recording medium according to claim 2, further comprising an ultraviolet absorbing layer, wherein the ultraviolet absorbing layer is formed over a surface of the thermoreversible recording layer opposite to a surface thereof over which the support is formed.

5. The thermosensitive recording medium according to claim 4, wherein the ultraviolet absorbing layer contains a polymer having an ultraviolet absorption structure.

6. The thermosensitive recording medium according to claim 1, wherein the photothermal conversion is formed over a thermoreversible recording layer and the thermosensitive recording medium further comprises a thermoreversible recording layer containing a leuco dye and a reversible developer, in which color tone reversibly changes by heat, wherein the layer containing the photothermal conversion material is a photothermal conversion layer.

7. The thermosensitive recording medium according to claim 6, further comprising another thermoreversible recording layer, wherein the thermoreversible recording layers are formed over both surfaces of the photothermal conversion layer.

8. The thermosensitive recording medium according to claim 6, further comprising an intermediate layer, wherein the intermediate layer is formed between the photothermal conversion layer and the thermoreversible recording layer.

9. The thermosensitive recording medium according to claim 1, wherein the oxygen blocking layer has an oxygen permeability of 0.1 mL/($m^2$·24 hr·atm) or less at 25° C. and 80% RH.

10. The thermosensitive recording medium according to claim 1, wherein the oxygen blocking layer has an oxygen permeability of 0.05 mL/($m^2$·24 hr·atm) or less at 25° C. and 80% RH.

11. The thermosensitive recording medium according to claim 1, wherein the oxygen blocking layer is an inorganic deposited film.

12. The thermosensitive recording medium according to claim 11, wherein the inorganic deposited film is a silica deposited polyethylene terephthalate film.

13. The thermosensitive recording medium according to claim 11, wherein the inorganic deposited film is a laminate consisting of two or more layers.

14. An image processing method comprising any one of:

heating a thermosensitive recording medium with a laser light irradiation so as to record an image thereon; and heating the thermosensitive recording medium with a laser light irradiation so as to erase an image therefrom, wherein the thermosensitive recording medium comprises:

a support;

a photothermal conversion layer containing a photothermal conversion material, formed over the support; and an oxygen blocking layer formed over the photothermal conversion layer, wherein the photothermal conversion layer further contains a resin, which is in a cross-linked state, and the photothermal conversion material absorbs a light having a specific wavelength and converts the light into heat, wherein the oxygen blocking layer has an oxygen permeability of 0.5 mL/($m^2$·24 hr·atm) or less at 25° C. and 80% RH, and wherein the photothermal conversion layer is also a thermoreversible recording layer or the photothermal conversion is not a thermoreversible recording layer and the thermosensitive recording medium further comprises a thermoreversible recording layer.

15. The image processing method according to claim 14, wherein the laser light has a wavelength of 600 nm to 1,200 nm,

16. The image processing method according to claim 14, wherein the laser light is at least one selected from the group consisting of a YAG laser light, a fiber laser light, and a semiconductor laser light.

* * * * *